US007736084B2

(12) United States Patent
Causey et al.

(10) Patent No.: US 7,736,084 B2
(45) Date of Patent: Jun. 15, 2010

(54) PAYOUT BRAKE

(75) Inventors: Lynn R. Causey, Russellville, AL (US); Roger D. Causey, Russellville, AL (US)

(73) Assignee: Causey Lyon Enterprises, Inc., Russellville, AL (US)

( * ) Notice: Subject to any disclaimer, the term of this patent is extended or adjusted under 35 U.S.C. 154(b) by 419 days.

(21) Appl. No.: 11/904,732

(22) Filed: Sep. 28, 2007

(65) Prior Publication Data

US 2009/0084885 A1 Apr. 2, 2009

(51) Int. Cl.
*E01F 13/12* (2006.01)
*E01F 15/06* (2006.01)

(52) U.S. Cl. ..... 404/6; 256/13.1

(58) Field of Classification Search ..... 404/6; 256/13.1

See application file for complete search history.

(56) References Cited

U.S. PATENT DOCUMENTS

| | | | | |
|---|---|---|---|---|
| 1,654,606 | A | 1/1928 | Sawyer | |
| 3,069,118 | A | 12/1962 | Bernard | |
| 3,367,608 | A * | 2/1968 | Charno et al. | 244/110 R |
| 3,468,500 | A * | 9/1969 | Carlsson | 244/110 R |
| 3,738,599 | A * | 6/1973 | Borehag | 244/110 C |
| 4,101,235 | A | 7/1978 | Nelson | |
| 4,456,205 | A * | 6/1984 | Alavoine et al. | 244/110 C |
| 5,624,203 | A * | 4/1997 | Jackson et al. | 404/6 |
| 5,823,705 | A | 10/1998 | Jackson et al. | |
| 6,312,188 | B1 | 11/2001 | Ousterhout et al. | |
| 6,896,443 | B1 | 5/2005 | Ousterhout et al. | |
| 7,125,197 | B2 | 10/2006 | Krewsun et al. | |
| 7,195,419 | B2 | 3/2007 | Gelfand | |
| 7,210,873 | B2 | 5/2007 | Gelfand | |
| 2002/0109131 | A1 | 8/2002 | Smith et al. | |

FOREIGN PATENT DOCUMENTS

| | | |
|---|---|---|
| WO | WO/2006083429 | 8/2006 |

* cited by examiner

*Primary Examiner*—Raymond W Addie
(74) *Attorney, Agent, or Firm*—Schultz & Associates, P.C.

(57) ABSTRACT

Disclosed is an apparatus and method for decelerating moving vehicles. A set of two novel pylons is disclosed employing a simple, durable and reliable braking mechanism. Each braking mechanism comprises a spindle assembly including a brake disk and a spool assembly comprising a rotor and two caliper disks adjacent the brake disk. The spool assembly is pivotally mounted on the spindle assembly. As the strap is deployed a ratchet and pawl mechanism fixed to the base of the spindle assembly prevents the spindle assembly from rotating with respect to the spool assembly. The sliding friction between the caliper disks and the brake disk impedes the rotation of the spool assembly and restrains deployment of the strap. After impact, the strap can be rewound via a ratchet nut located on the spool assembly. During rewind the spindle assembly rotates with the spool assembly. An additional embodiment connects a sacrificial barrier between the two pylons mounted to a gantry.

25 Claims, 17 Drawing Sheets

PAYOUT BRAKE

FIELD OF THE INVENTION

This invention relates to traffic barriers for roadways. In particular, this invention relates to an apparatus and method for stopping oncoming vehicles while minimizing damage to them through use of a flexible strap connected between two adjustable payout brakes in opposing roadway pylons.

BACKGROUND OF THE INVENTION

In many instances, a need exists for controlling the path of cars and trucks. The prior art has devised many means for controlling such vehicles including barriers such as guard rails and crossing gates. Often the intended purpose of such barriers is to protect vehicles from entering secure areas such as government installations or unsafe areas such as construction sites or reversible high-occupancy vehicle lanes. However, in most cases, prior art barriers inflict extremely high deceleration rates on vehicles and can cause extensive damage to the vehicles and the barriers. Further, safety of the driver and passengers in such a vehicle is often compromised. Further, repairing the damage to the barriers can be time consuming and expensive.

Some barrier systems of the prior art have attempted to remedy the problems created by high deceleration rates by devising brakes of various configurations designed to decelerate vehicles relatively slowly. The prior art brakes are designed for dissipating its kinetic energy by translation of that energy into heat by friction.

Of course, the kinetic energy of the vehicle increases with the square of its velocity according to the equation $E=1/2\ mv^2$. As the speed of the vehicle doubles, the kinetic energy increases by 4 times. The braking systems must therefore dissipate 4 times as much energy to stop the vehicle and consequently require 4 times the distance to do so. The energy stored as heat is gradually released to the surrounding environment.

Prior art efforts to control the straight line deceleration of vehicles with barrier systems include various types of barriers which incorporate braking mechanisms. U.S. Pat. No. 6,312,188 to Ousterhout, et al. discloses a device and associated method for impeding the motion of a land vehicle traveling along a pathway on a terrain surface. Two opposing supports are positioned at opposite sides of a vehicle path of travel. Each support is capable of being actuated from a compressed condition to an extended condition. A propulsion system actuates the supports. When the supports are compressed, vehicles pass over the barrier unimpeded. When the supports are actuated, the barrier rises to a position in the path of motion of a vehicle. Each support includes a deceleration cable that is wound around an axle system of a brake box. The axle system is comprised of outer and inner nested shafts which include a pawl and ratchet. A spring loaded caliper system applies a constant clamping force to a brake disk. As the deceleration cable is withdrawn from the brake box, the unwinding of the cable rotates the axle and in turn rotates the brake disk via the locked ratchet mechanism. To rewind the deceleration cable around the axle, a rotational force is applied to the axle via a hexagonal nut on the end of the axle. The pawl unlocks and the cable is rewound around the axle without rotating the brake disk. The brake force is applied by a relatively small brake pad thereby reducing the maximum braking force available. Further, the braking force is not adjustable.

U.S. Patent Application Publication No. 2002/0109131A1 to Smith, et al. discloses a braking system that provides a varied braking force to maintain the rate of deceleration of a vehicle at or below a predetermined value. The system includes a guardrail structure and an impact sled positioned ahead of the guardrail structure. The guardrail structure and the impact sled are connected to two guide rails. A braking unit is positioned within the impact sled. When a vehicle collides with the impact sled, the impact sled collides with the braking unit and the guardrail structure is caused to move vertically and fold. Hydraulic pressure builds in the braking unit so that a braking force is applied to the brake rails. A force sensing valve regulates pressure from the braking unit until the rate of deceleration reaches a predetermined value. The system is not physically damaged through use. The disclosed system is costly and mechanically complicated.

U.S. Pat. No. 7,125,197 to Krewsun, et al. discloses a vehicle capture net disposed between a pair of towers each of which includes a shaft, a pair of spools coupled to the shaft, and a pair of straps connected to the net. Each strap is wound on a spool. Unwinding of the straps from the spools advances the pair of spools on threaded portions of a shaft to compress a frictional brake. The degree of compression increases as the strap unwinds, thereby increasing the magnitude of the restraining force as the straps are unwound. An electric motor and clutch assembly releases the brake and rewinds the strap on the spool. The system disclosed is complicated and potentially prone to high maintenance expense.

SUMMARY OF INVENTION

In one embodiment, an apparatus and method for stopping moving vehicles with a flexible strap between stationary pylons is disclosed. Each pylon is provided with a spindle assembly and a spool assembly. A brake assembly between the spool assembly and the spindle assembly inhibits the payout of the strap thus decelerating the vehicle in a controlled and adjustable manner. The brake gradually slows the vehicle to a stop without causing severe damage to the vehicle or the apparatus. The strap can be rewound into the pylons to reset the apparatus for reuse. The brake assembly is provided with a disk whose entire surface is utilized as a brake surface, increasing maximum braking capacity as well as the efficiency and useful life of each pylon. The braking force is adjustable so the apparatus may be used in various scenarios. One embodiment of the apparatus is designed to turn the vehicle as it is being decelerated. Another embodiment connects the strap from each pylon to a flexible fencing or netting.

The spindle assembly provides a hub and caliper combination. The spool assembly houses the strap and a brake disk. The spindle assembly is rotationally mounted to a mounting plate which is in turn mounted to a frame anchored to the ground. The spindle includes a base cylinder extending through the mounting plate and which supports a central spindle. The spindle assembly includes a ratchet and pawl mechanism that prevents the spindle assembly from rotation during the payout of the strap, but allows its rotation during rewind of the strap. The spindle assembly includes a gland nut that cooperates with a set of adjustable pressure bolts and an adjustable rotor plate to form one side of a brake caliper. The other side of the caliper is formed by an integrally formed disk attached to the spindle.

The spool assembly pivots on the central spindle of the spindle assembly by virtue of a central hub. The spool assembly includes a channel which spools the strap. The channel is connected to a rotor plate that fits within the caliper. The channel is also connected to the hub and includes an integrally formed ratchet nut. The ratchet nut is used to rotate the spool assembly to rewind the strap assembly after deployment. The ratchet and pawl mechanism of the spindle assembly unlocks during rewind so that the spool assembly and the spindle assembly rotate together by virtue of the friction force between the rotor plate and the caliper.

In another embodiment, the rotor plate of each pylon is adjusted to a different frictional force. In this embodiment, when a vehicle impacts a strap, the strap is drawn from each of the pylons at differing rates. The differing rates cause the vehicle to decelerate in an arc as opposed to a straight line, thereby shortening the deceleration distance relative to the plane defined by the two pylons In another embodiment, the strap is connected to a collapsible barrier. A gantry is provided with a vertical support structure. The vertical support structure is fitted with movable carriages that carry the pylons. The carriages may be raised and lowered on the support structure aided by counterweights.

When a vehicle impacts the strap, the strap is drawn from the pylons by rotating each spool assembly with respect to each spindle assembly. During the payout of the strap, the ratchet and pawl mechanisms prevent the spindle assemblies from rotating as the spool assemblies rotate to deploy the collision strap. The rotor plates rotate against the frictional forces applied to them by the calipers of each spindle assembly. The frictional forces impede the rotation of the spool assemblies which slows the payout of the strap and ultimately decelerates the vehicle.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
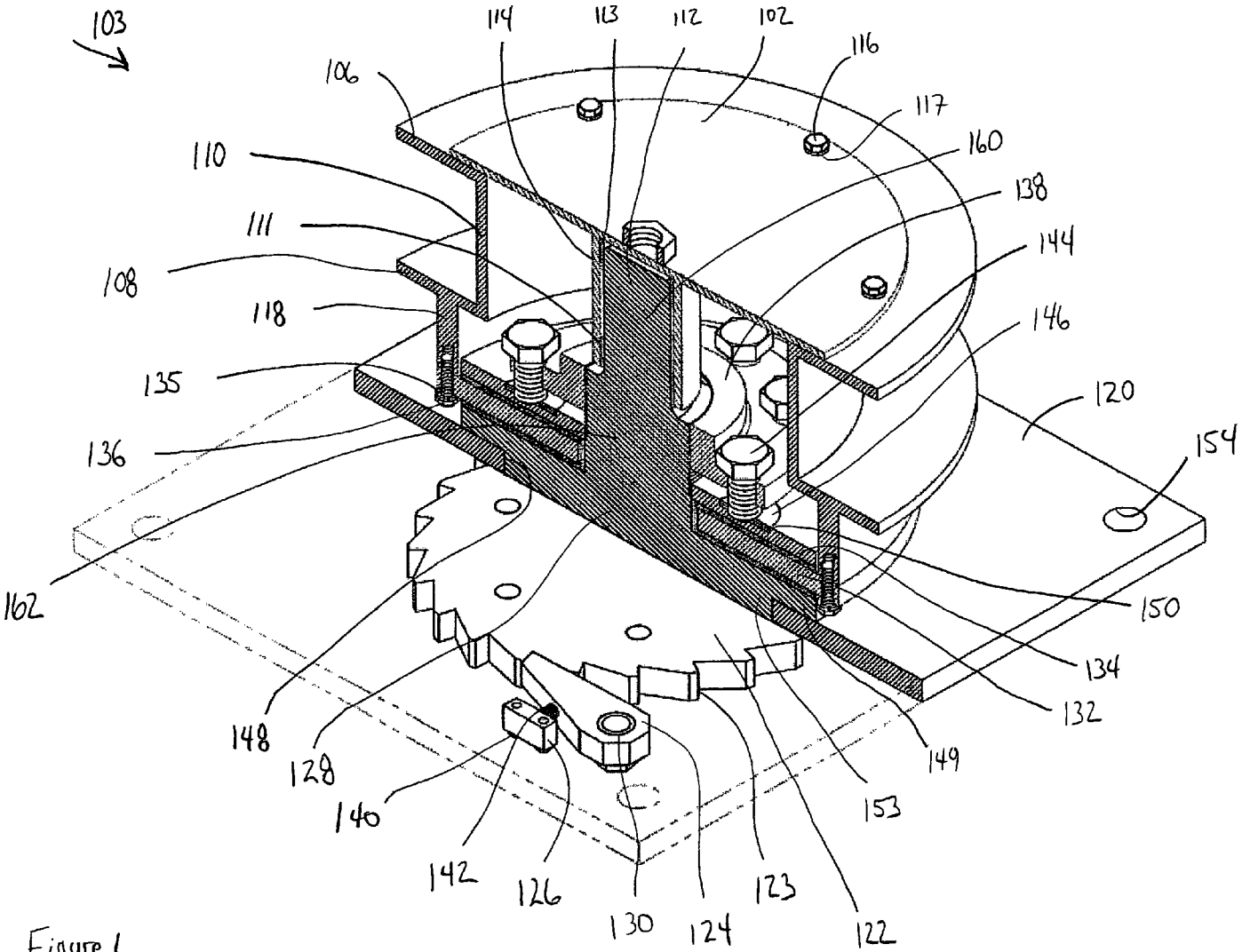
FIG. 1 is an isometric sectional view of a preferred embodiment of a payout brake of the present invention.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Figure 6:
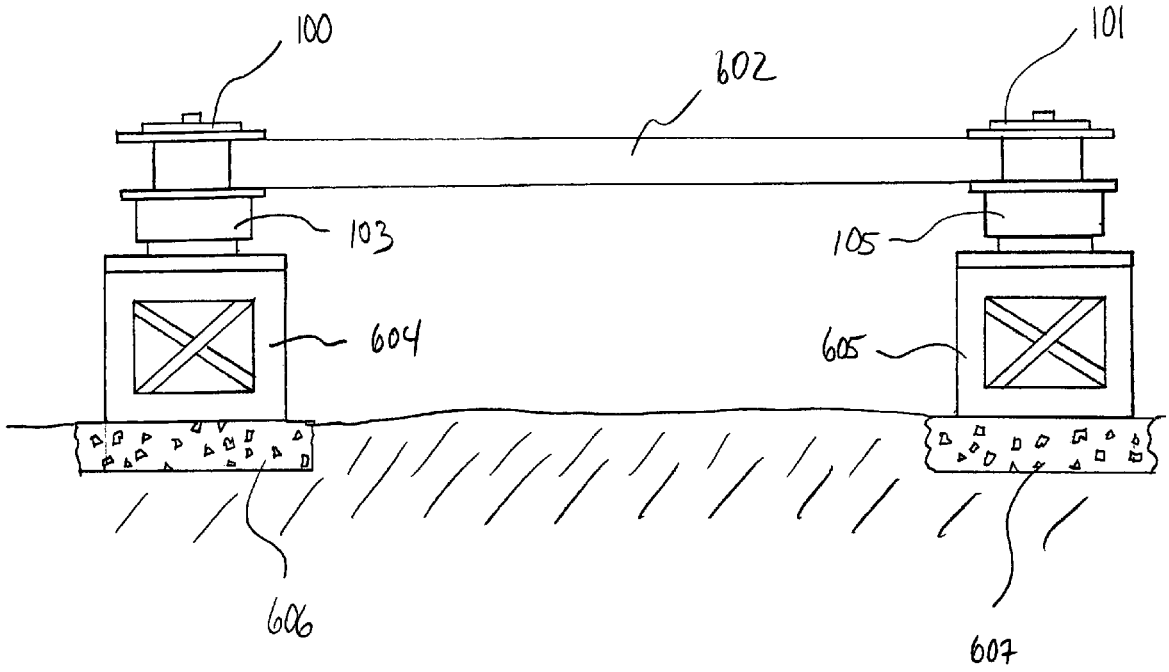
FIG. 6 is an elevation view of two payout brakes connected by a flexible strap.

The present invention is a barrier for roadways that stops or incapacitates oncoming vehicles without damaging them using a flexible collision strap positioned between two variable pressure payout brakes housed in opposing pylons. As can be seen in FIG. 6, pylon 100 and identical or mirror image pylon 101 including identical payout brakes are placed adjacent a roadway on opposite sides. Strap 602 extends between the two pylons. It is understood by those skilled in the art that the portion of the flexible strap designed to make contact with the moving vehicle may take various shapes and forms as is known in the art. Such forms would include netting of various patterns and combinations of straps and padding designed to cradle the front of a vehicle to remove damage and to prevent the vehicle from slipping or flipping. One set of examples is shown in U.S. Pat. No. 6,312,188 to Ousterhout, et al., which is incorporated herein by reference. Other examples are explained later in this disclosure.

Pylon 100 includes a payout brake 103 which is fixed to stand 604 which is in turn attached to anchor 606. Stand 604 is generally a high strength steel square or rectangular shaped truss frame anchored to the ground. In the preferred embodiment, anchor 606 is a steel reinforced concrete slab ranging from approximately twelve (12) to thirty-six (36) inches in depth and occupying a footprint of approximately four (4) square feet. Other anchoring methods known in the art such as concrete piers or connection directly to the roadway or bridge deck may also suffice. Similarly, pylon 101 includes payout brake 105, stand 605 and anchor 607.

Figure 2:
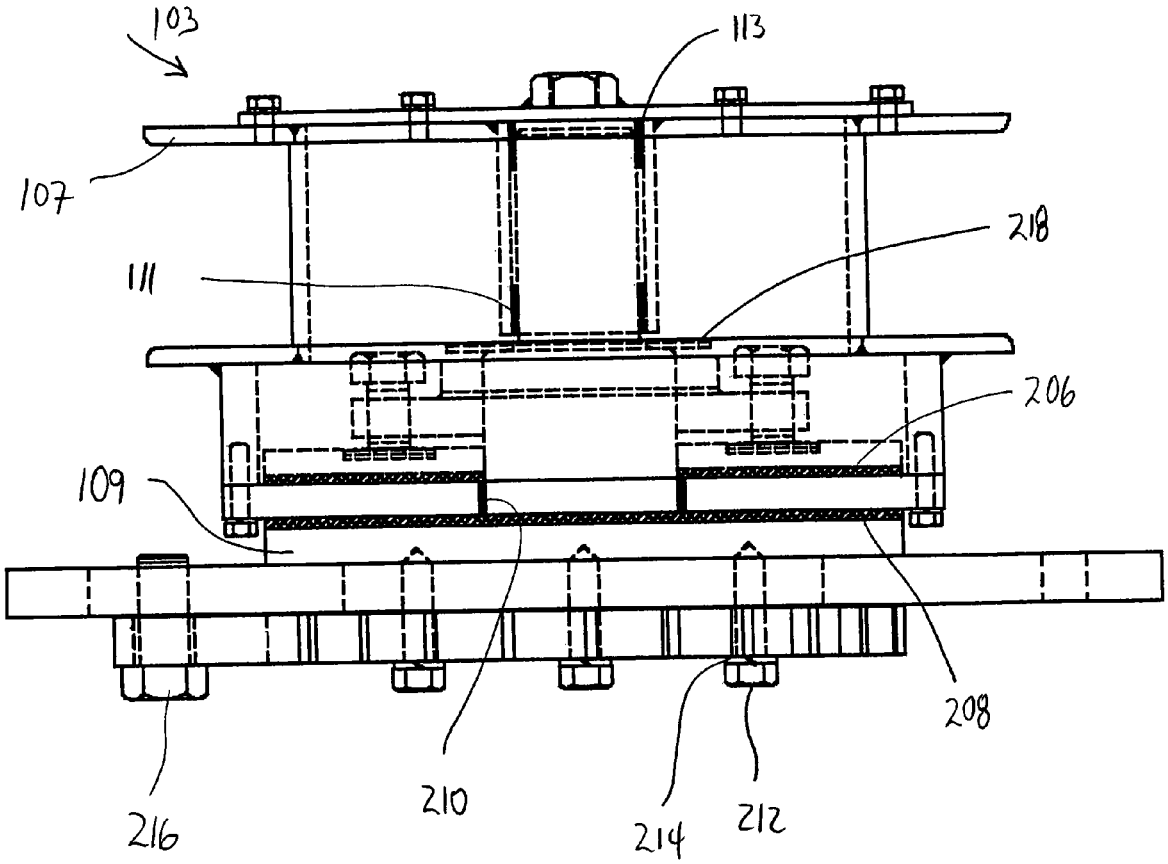
FIG. 2 is an elevation view of a preferred embodiment of a payout brake of the present invention.
Figure 3:
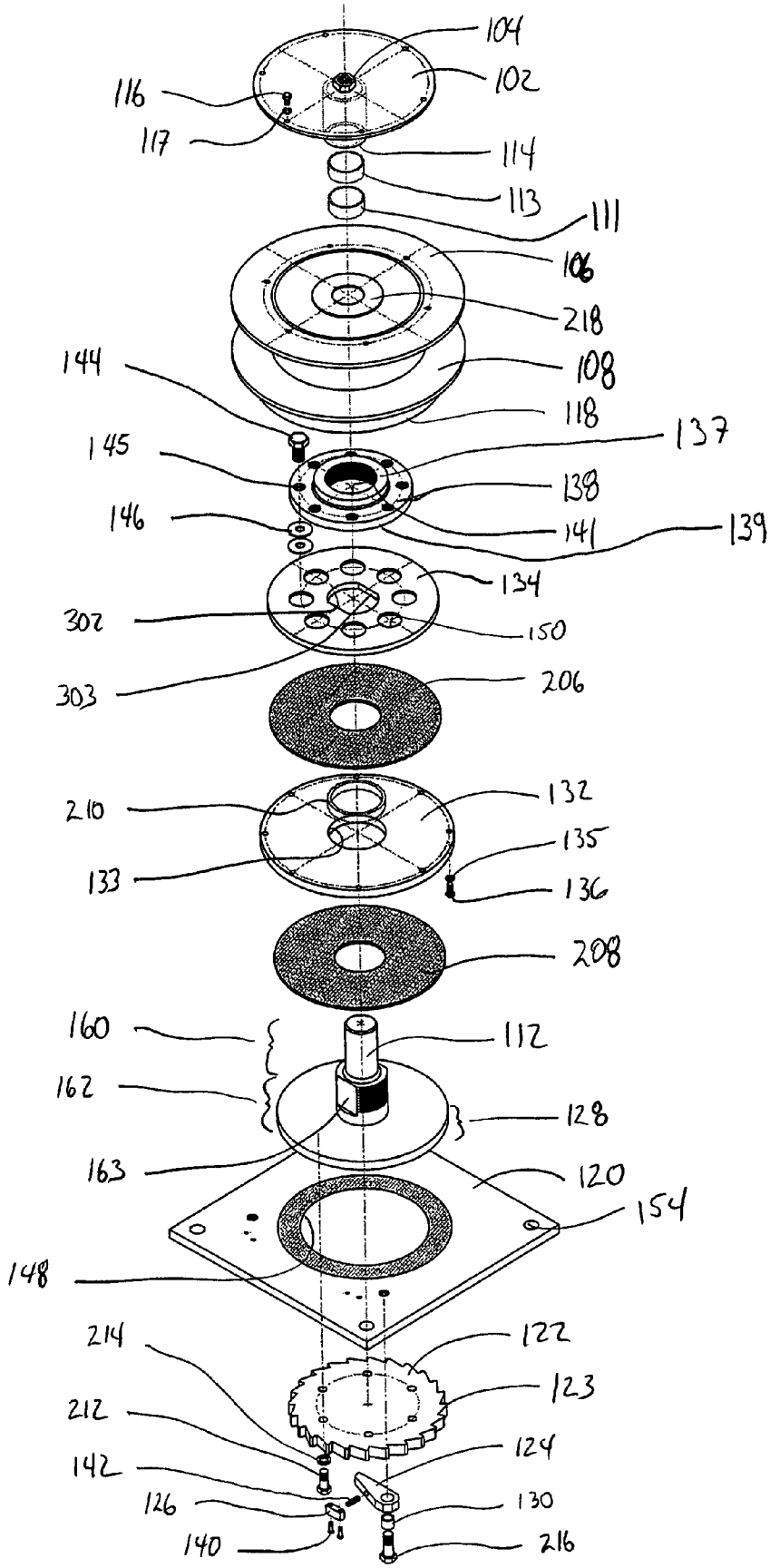
FIG. 3 is an exploded isometric view of the components of a preferred embodiment of a payout brake of the present invention.

The components of payout brake 103 can be seen in FIGS. 1, 2 and 3. The payout brake includes a spool assembly 107 and a spindle assembly 109.

The spool assembly includes two spool flanges 106 and 108, spool hub cylinder 110, spool mount cylinder 118, guide plate 102, ratchet nut 104, guide plate hub 114 and brake disk 132. The spindle assembly includes spindle 112, gland nut 138, rotor plate 134 and ratchet plate 122.

The components of the spool assembly are concentrically aligned with and rotate around spindle 112. Guide plate 102 is a flat circular disc and includes a concentrically aligned ratchet nut 104. In the preferred embodiment, ratchet nut 104 is integrally formed with or welded to guide plate 102. The ratchet nut is welded to the guide plate around its perimeter using a ¼ inch fillet weld. The opposite side of guide plate 102 includes an integrally formed perpendicular guide plate hub 114. Guide plate hub 114 is a hollow cylinder. Guide plate hub 114 is supported by and pivots on spindle 112. Bushings 111 and 113 are provided between the interior surface of guide plate hub 114 and upper section 160 of spindle 112. The bushings are brass bushings in the preferred embodiment impregnated with a lubricant as is known in the art. The bushings are press fit into the guide plate hub and hold their positions by virtue of an interference fit. In the preferred embodiment, the guide plate hub is constructed of A-519 steel tubing with ¼ inch walls.

Figure 5:
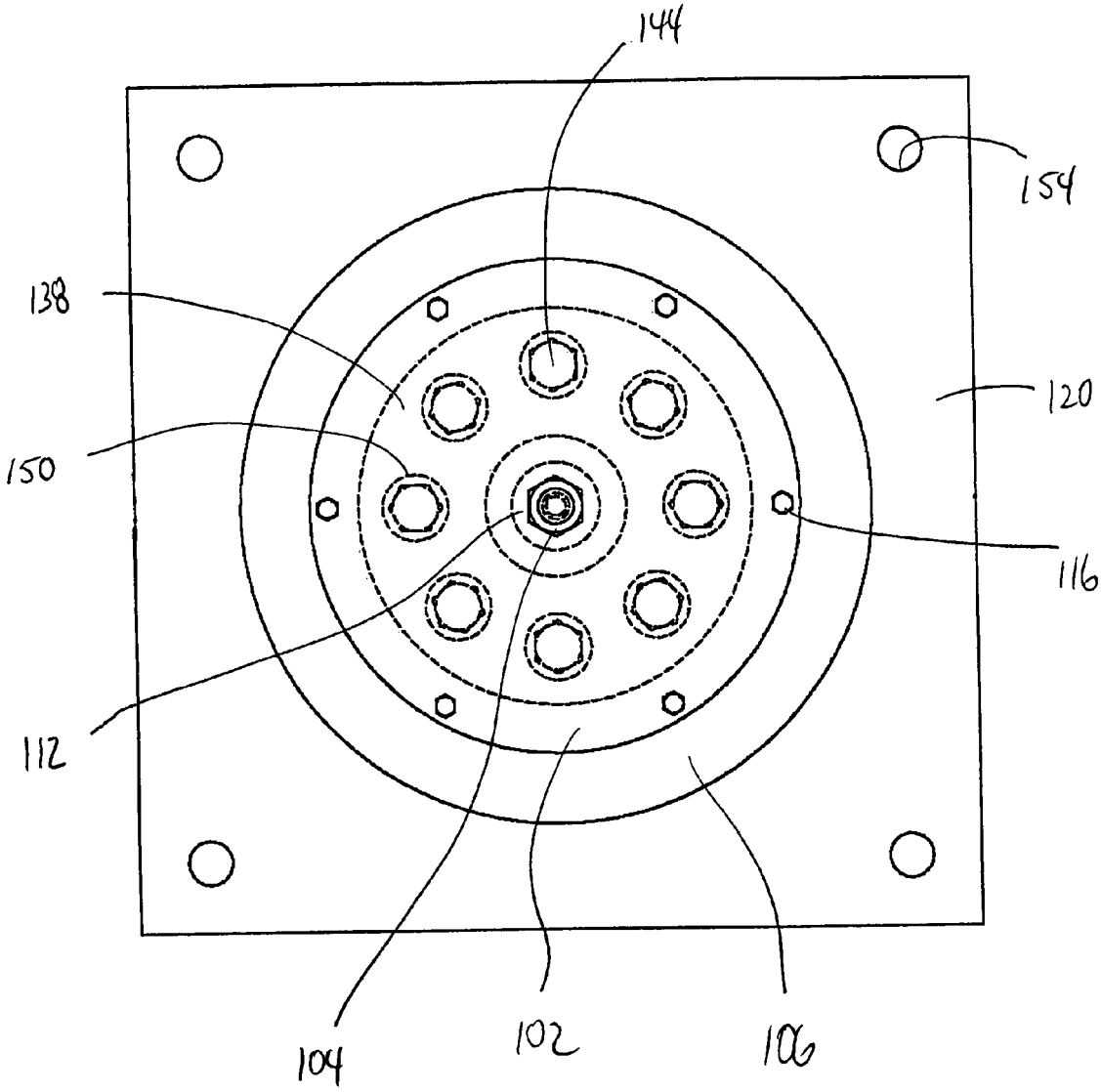
FIG. 5 is a plan view from the top side of a preferred embodiment of a payout brake of the present invention.

FIG. 5 shows the top of a payout brake. Guide plate 102 is affixed to spool flange 106. In the preferred embodiment, six equally spaced guide plate mounting bolts 116 each having lock washers 117 secure spool flange 106 to guide plate 102. Referring to FIGS. 1, 2 and 3, spool hub cylinder 110 is integrally formed with spool flanges 106 and 108 creating a channel with a generally "U-shaped" cross-section. Spool mount cylinder 118 is integrally formed with spool flange 108. Spool mount cylinder 118 is connected to brake disk 132 by a plurality of brake disk mounting bolts 136. Lock washers 135 inhibit the bolts from backing out during use. Brake disk 132 is a flat disk that acts as the brake disk between the caliper action of the spindle assembly. In the preferred embodiment, the brake disk is machined flat to a 2 tenths tolerance. Brake disk bushing 210 located between brake disk 132 and midsection 162 of spindle 112 serves as a bearing between the two surfaces as the spool assembly rotates around spindle 112. The bushings of the preferred embodiment are of self lubricating brass composite. Brake disk 132 includes a concentric circular hole 133 that circumscribes spindle 112. All of the components of the spool assembly are constructed of steel or aluminum. In the preferred embodiment, guide plate 102 and guide plate hub 114 are A16 steel plate. The guide plate, guide plate hub, spool flanges, spool mount cylinder and brake disk are all A-519 steel or equal and ¼ inch thick.

The components of the spindle assembly are also shown in FIGS. 1, 2 and 3. The components of the spindle assembly include spindle 112, rotor plate 134, gland nut 138, pressure bolts 144, Belleville spring washers 146, and ratchet plate 122. Spindle 112 is an axially symmetric construct whose longitudinal axis forms the axis of rotation for itself and the spool assembly. Spindle 112 is comprised of upper section 160, midsection 162, spindle base plate 149 and spindle alignment cylinder 153. Upper section 160 is a cylindrical stanchion fitting within guide plate hub 114. Midsection 162 is also a cylindrical stanchion, except for two opposing flat surfaces 163. Adjacent the flat surfaces, midsection 162 is threaded to receive gland nut 138. Adjacent midsection 162 is spindle base plate 149 and spindle alignment cylinder 153. Spindle base plate 149 serves as one side of a cylindrical brake caliper. The surface of spindle base plate 149 is machined flat to a tolerance of about 2 tenths of a mil to maximize the contact area with the lower brake lining. Spindle alignment cylinder 153 fits into base hole 148 in mounting plate 120 and serves to pivotally mount the spindle assembly to the mounting plate. In the preferred embodiment, spindle alignment cylinder 153 and spindle base plate 149 are approximately ½ inch thick.

Rotor plate 134 is a circular disc that forms another side of a caliper on the spindle assembly. Rotor plate 134 includes rotor plate hole 302 (shown in FIG. 3), including two opposing flat sides 303. Rotor plate 134 fits concentrically around the midsection of the spindle and is axially movable. The opposing flat surfaces conform to the flat surfaces of the midsection and prevent rotation of the rotor plate with respect to the spindle.

Rotor plate 134 includes on its upper surface a plurality of spring seats 150. Spring seats are ⅛ inch deep circular indentions in the rotor plate. Spring seats 150 house Belleville spring washers 146. As is known in the art, Belleville spring washers 146 are hemispherical shaped springs that, in use, maintain assembly tension and compensate for expansion or contraction of materials due to heat. In the preferred embodiment, Belleville spring washers 146 provide contact points for pressure bolts 144 on the rotor plate and distribute the axial force of each bolt over the surface of the rotor plate. The pressure bolts cooperate with gland nut 138 to provide equally distributed and adjustable pressure on rotor plate 134. In the preferred embodiment, there are eight (8) pressure ¾ inch×1½ inch bolts, machine threaded. The eight pressure bolts are spaced in a regular circular pattern equidistant from each other and the edges of the gland nut flange. In the preferred embodiment, pressure bolts 144 are fine threaded and self-locking, eliminating the need for jam nuts.

Gland nut 138 includes gland nut flange 139 and gland nut collar 137. Gland nut collar 137 includes hole 141. Hole 141 is threaded to cooperate with the threads on midsection 162. Gland nut flange 139 also includes eight threaded holes 145 for receipt of pressure bolts 144. In the preferred embodiment, gland nut collar 137 is approximately 1 inch thick and gland nut flange 139 is approximately ½ inch thick. Spacer 218 surrounds spindle 112 between the base of guide plate hub 114 and the top of gland nut 138. In the preferred embodiment spacer 218 is made of aluminum or steel and is approximately ⅛ inch thick. All the components of the spindle assembly are formed from AISI 4140 steel, machined to a tolerance and case hardened.

Figure 4:
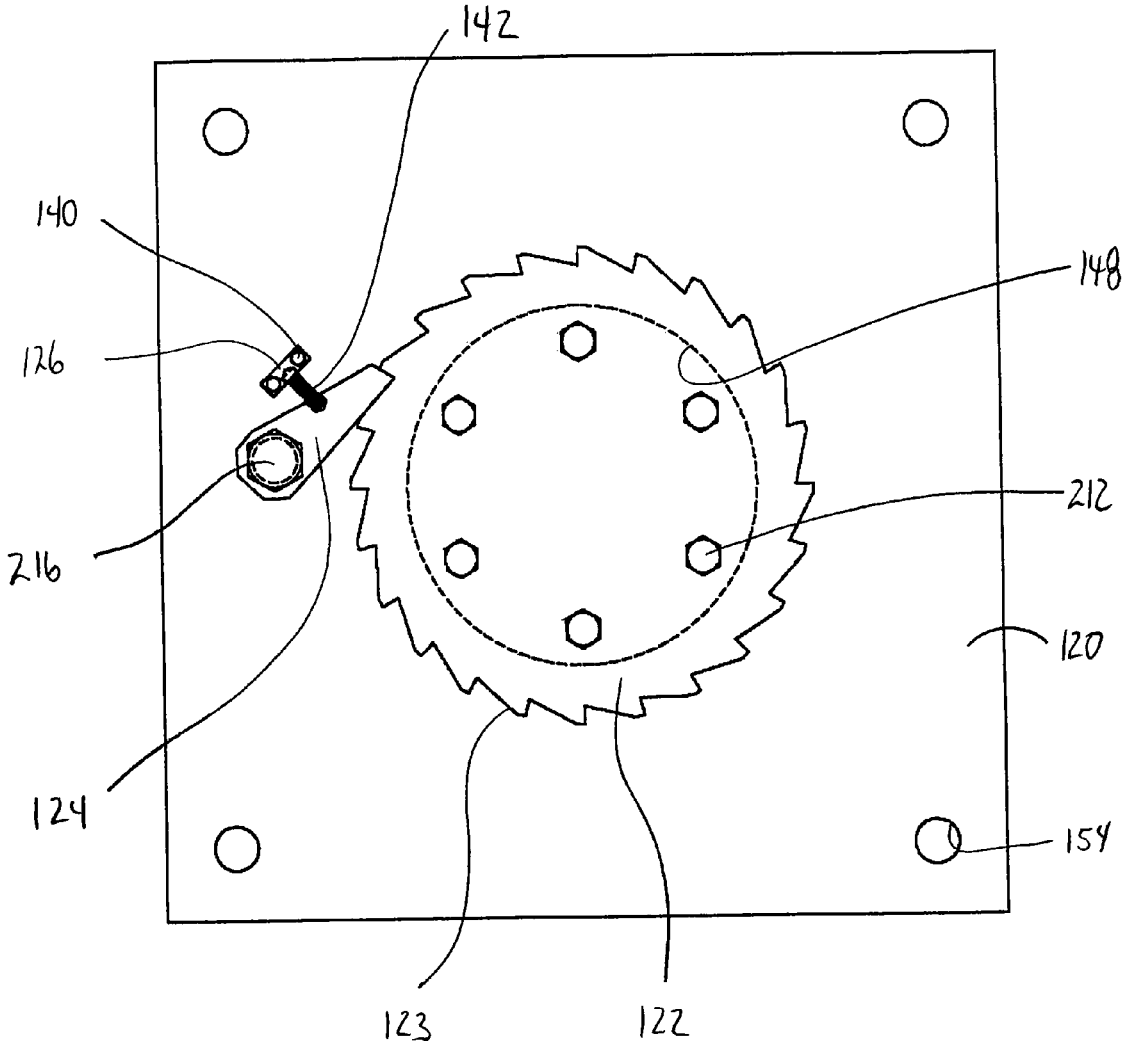
FIG. 4 is an underside view of a preferred embodiment of a payout brake of the present invention.

As shown in FIG. 4, ratchet plate 122 is affixed to spindle base 128 as it extends through base hole 148 of mounting plate 120. Ratchet plate 122 is a circular member having a serrated edge ratchet surface 123 along its circumference. In the preferred embodiment, six equally spaced ratchet mounting bolts 212 each having lock washers 214 secure ratchet plate 122 to spindle base 128. In the preferred embodiment, ratchet plate 122 is approximately ¾ inch thick and rotor plate 134 is approximately ½ inch thick. The ratchet plate is machined from AISI 4140 steel.

Pawl 124 is mounted to mounting plate 120 with pawl mounting bolt 216 adjacent to and in cooperation with ratchet plate 122. Pawl bushing 130 serves as a bearing between pawl 124 and pawl mounting bolt 216. Spring block 126 is affixed to mounting plate 120 by a pair of spring block mounting bolts 140. Pawl spring 142 is simultaneously seated in spring block 126 and pawl 124. Pawl spring 142 biases pawl 124 against ratchet plate 122.

Figure 10:
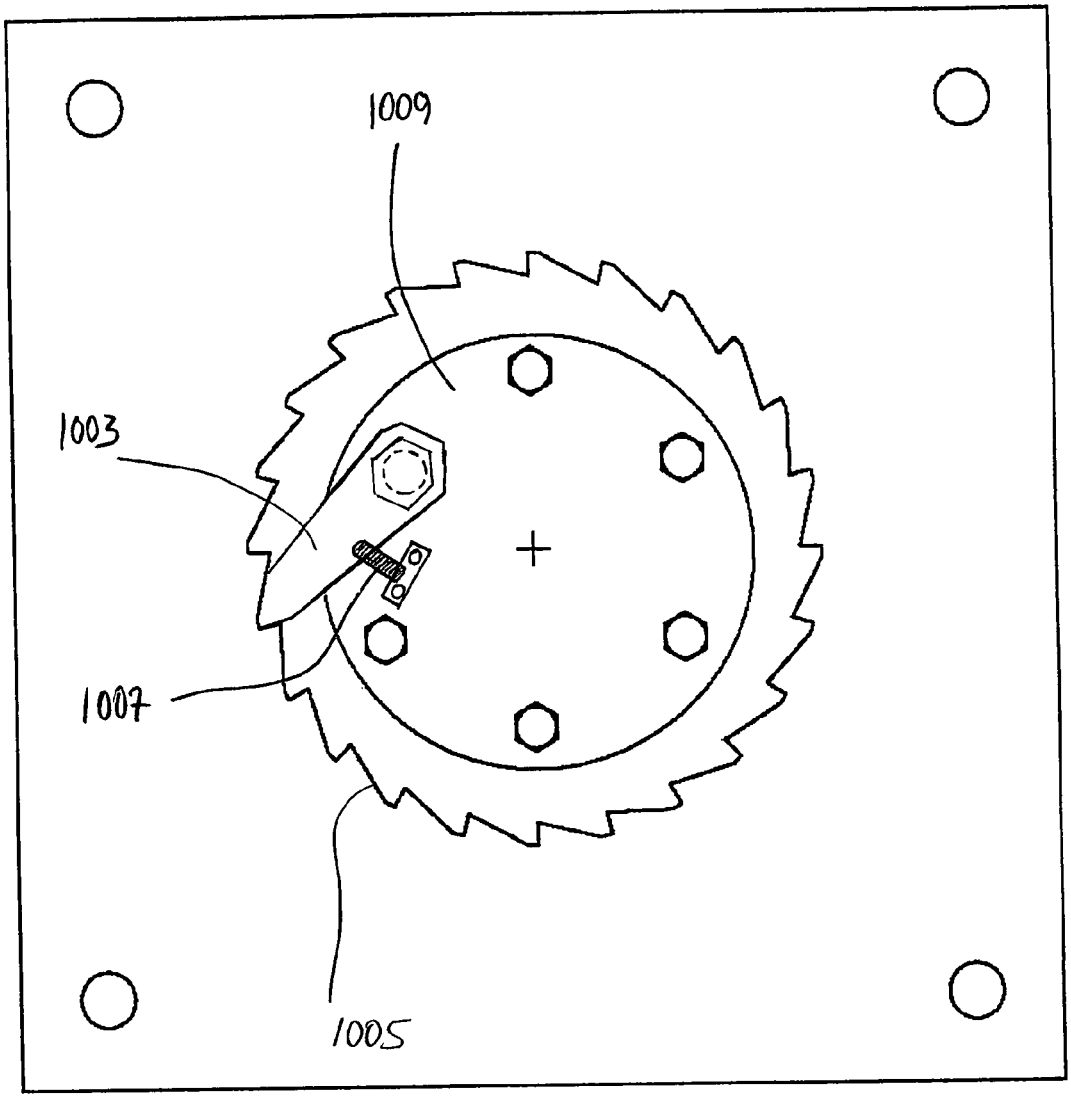
FIG. 10 is an underside view of an alternate embodiment of a payout brake of the present invention showing a pawl attached to a circular plate

As shown in FIG. 10, in another embodiment, a spring loaded pawl 1003 can be rigidly attached to a circular plate 1009 which is, in turn, connected to spindle base 128. In this embodiment, a ratchet surface 1005 is included in the mounting plate adjacent pawl 1003. Spring 1007 biases pawl 1003 against ratchet surface 1005 thus allowing the spindle assembly to rotate in one direction with respect to the mounting plate but not the other.

In between brake disk 132 and spindle base plate 149 is lower brake lining 208. In between brake disk 132 and rotor plate 134 is upper brake lining 206. In the preferred embodiment, both upper brake lining 206 and lower brake lining 208 are made of a composite fiberglass carbon fibers and asbestos fibers as is known in the art. Upper brake lining 206 and lower brake lining 208 may be bonded to brake disk 132 with a high temperature adhesive. In an alternate embodiment, the frictional surfaces of upper brake lining 206 and lower brake lining 208 are integrally formed with brake disk 132. In another alternative embodiment, the upper brake lining and the lower brake lining are not connected to the brake disk and are free to rotate.

Mounting plate 120 is a square or rectangular shaped base member. Mounting plate 120 includes four mounting plate holes 154 proximate its corners through which bolts are used to secure a payout brake to a stand. In the preferred embodiment, mounting plate 120 is made of ¾ inch steel. Mounting plate 120 also includes a centrally located circular hole shown as base hole 148. Stand 604 (shown in FIG. 6) is a truss constructed of 2 inch square steel bar stock. Of course, other rigid frame designs and shapes for the mounting plate will suffice.

In use, pylons 100 and 101, each including a mirror image payout brake, are mounted to stands 604 and 605 which are in turn anchored to the ground opposite a roadway. Strap 602 is placed between the two payout brakes 103 and 105 and wound into the channels on each spool assembly. The guide plate of each spool assembly is then removed to allow access to the pressure bolts. The torque on each pressure bolt is then adjusted to increase or decrease the braking force to be executed by each payout brake. Each guide plate is then replaced.

Adjusting the torque on each of the pressure bolts 144 increases or decreases the force on brake disk 132 exerted by rotor plate 134 and spindle base plate 149 via brake linings 206 and 208, respectively. An increased amount of force exerted by rotor plate 134 on brake disk 132 increases the amount of torque required to rotate the spool assembly and hence deploy the strap from the payout brake. Increasing the torque of the payout brake allows the apparatus to decrease the stopping distance of a particular vehicle. The stopping distance is a function of the vehicle weight, the vehicle speed, and the torques settings in each payout brake. The torque setting on each payout brake may be equal or different depending on the application.

Figure 7:
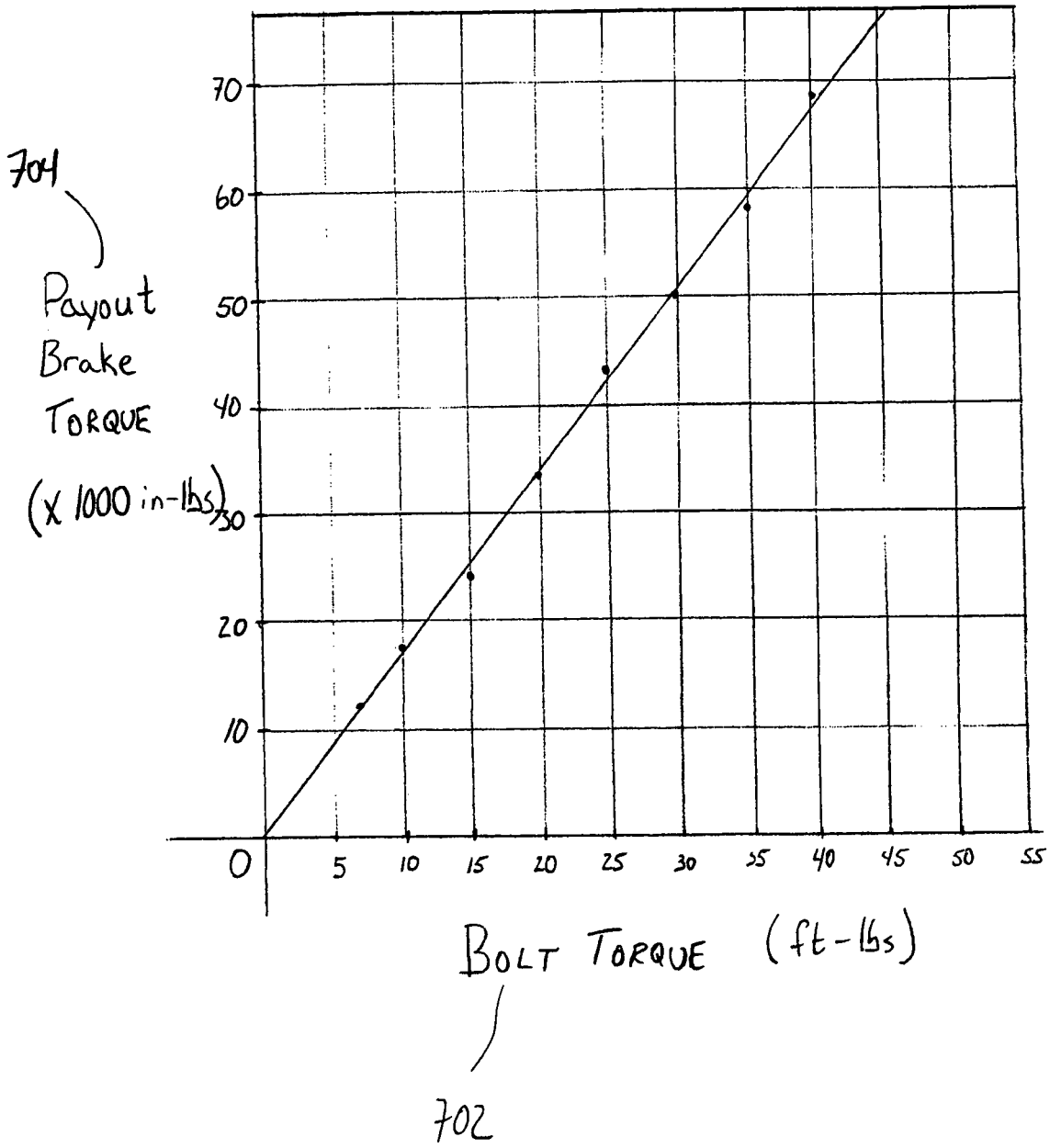
FIG. 7 is an X-Y plot of Bolt torque versus Payout System torque.

FIG. 7 is a graph of the torque required on pressure bolts 144 to achieve various torque settings of the spool assembly. Pressure bolt torque 702 is shown on the X-axis and is measured in foot-pounds. Payout system torque 704 is shown on the Y-axis and is measured in inch-pounds.

Upon impact by a vehicle, the spooled strap is deployed from the spool assemblies by rotation of each spool assembly with respect to each spindle assembly. Each spindle assembly remains stationary with respect to the mounting plate. The pawls prevent the rotation of the spindle assemblies by seizing the ratchet plates. The friction as exerted by the brake linings between the brake disks, the spindle bases and the rotor plates impedes the rotation of the spool assemblies, thus applying a tension force to the strap which decelerates the vehicle.

Figure 8:
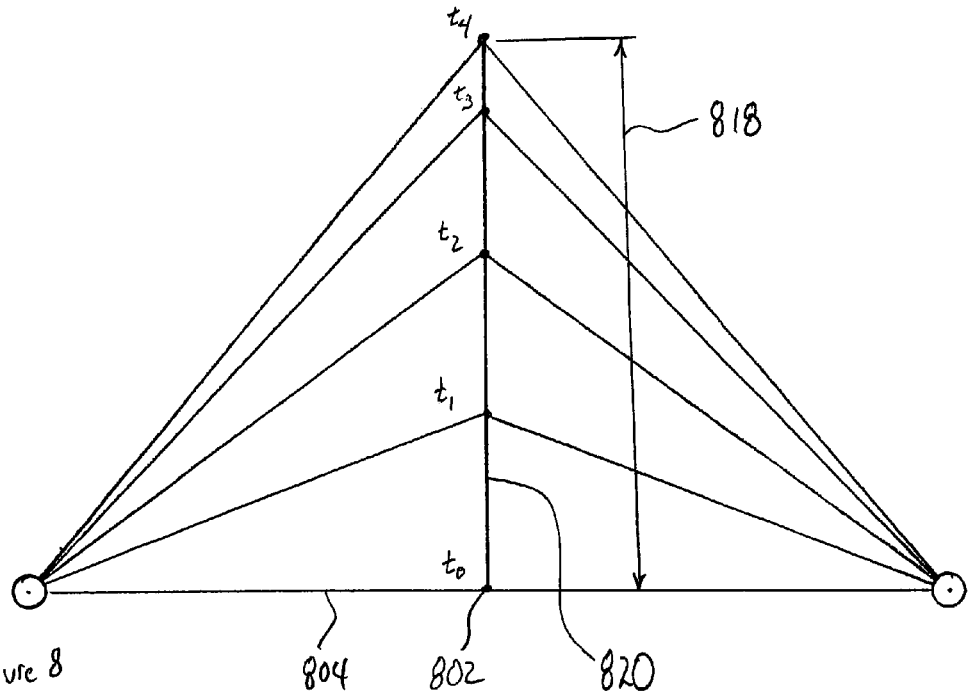
FIG. 8 is a diagram of the deployment of a strap between two equally adjusted payout brakes of the present invention.

FIG. 8 is a graphical illustration showing a deployment of strap 804 after impact by a vehicle traveling at a rate of 20 mph. To simplify the illustration, in both FIGS. 8 and 9, the vehicle will be represented by a point on the strap. In this example, the torque value adjustment of each payout brake is 30,000 in-lbs. Five different instants in time are shown. At $t_0$, vehicle 802 impacts strap 804 and the distance from the pylons is zero. At $t_1$, 0.25 seconds after impact, strap 804 begins to deploy from both pylons at an equal rate and the distance the vehicle has traveled after impact is 6.6 feet resulting in a payout strap distance of 1.4 feet from each pylon. At $t_2$, 0.5 seconds after impact, strap 804 continues to deploy from both pylons at an equal rate and the distance the vehicle has traveled after impact is 11.7 feet resulting in a payout strap distance of 4 feet from each pylon. At $t_3$, 0.75 seconds after impact as the vehicle continues to decelerate, the distance the vehicle has traveled after impact is 15.3 feet with a strap payout distance of 6.4 feet from each pylon. Finally, at $t_4$, approximately 1 second after impact, the vehicle comes to a stop after traveling a distance of 17.7 feet, shown as 818, resulting in a total strap payout of 8.2 feet from each pylon. Deceleration path 820 shows the linear path vehicle 802 traversed while being decelerated.

Figure 9:
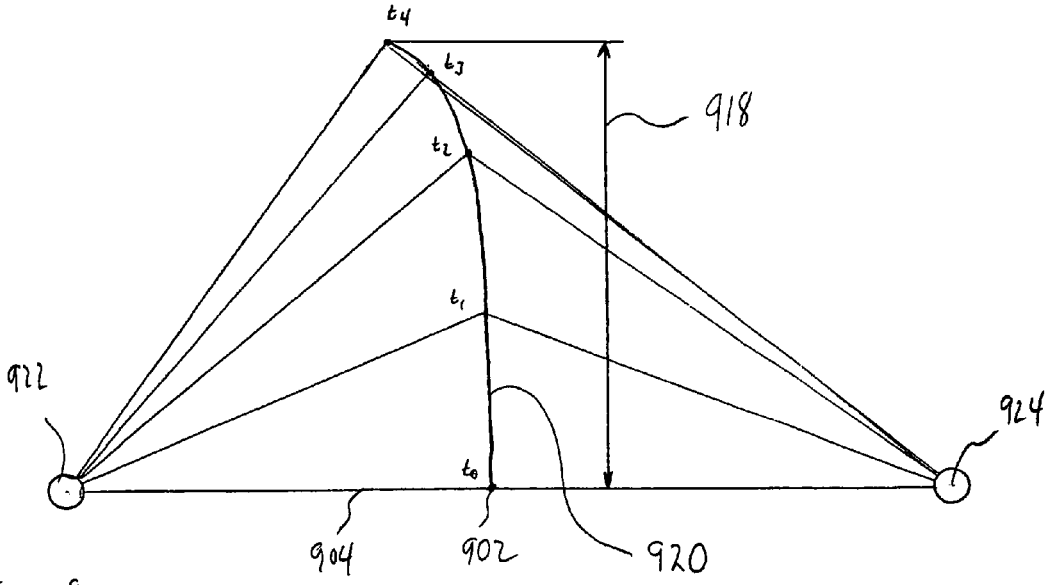
FIG. 9 is a diagram of the deployment of a strap between two unequally adjusted payout brakes of the present invention

In certain applications, it may be necessary to turn the vehicle during deceleration to avoid obstacles in its path or to follow a roadway which curves abruptly. FIG. 9 shows a deployment of the strap where the torque settings differ in each payout brake resulting in a curvilinear deceleration path 920. The actual length of the path traveled during deceleration is a function of vehicle weight, vehicle speed, and the torque setting of each payout brake, but the direction of the deceleration path traveled is altered. Accordingly, deceleration path 820 is approximately the same length as deceleration path 920, but the longitudinal distance traveled from the pylons 918 is reduced.

FIG. 9 is a graphical depiction of a curvilinear deceleration path where the payout brake of pylon 922 is set to a greater torque value than the torque value of the payout brake of pylon 924. In this example, pylon 922 has a torque adjustment of 48,000 in-lbs while pylon 924 has a torque adjustment of 30,000 in-lbs. Of course, the torque adjustment of either pylon can be less than the other, resulting in a turn of the vehicle deceleration path away from that pylon. The lesser torque value can be anywhere in the range of 10% to 100% lower. In this example, the payout brake of pylon 922 will provide a greater tension force to deploy the strap than will the payout brake of pylon 924. During use, a greater length of strap 904 will be deployed from pylon 924 and at a greater rate than from pylon 922. At the moment of impact, vehicle 902 applies a determinable amount of force to strap 904. This force is a function of vehicular weight and rate of speed. When the force is greater than the torque value set in a pylon, the payout brake will rotate and deploy the strap. Once the vehicle has slowed to where its force is no longer greater than the frictional force created from the set torque value, the payout brake will stop rotating and the strap will cease to deploy.

Referring then to FIG. 9, at $t_0$, vehicle 902 impacts strap 904 and the distance from the pylons is zero. At $t_1$, 0.25 seconds after impact, the force vehicle 902 applies to strap 904 overcomes both the greater torque setting of pylon 922 and the lesser torque setting of pylon 924. The vehicle has traveled a longitudinal distance of 6.6 feet and a lateral distance of 0.1 feet towards pylon 922. Payout strap distance from pylon 922 is 1.2 feet while payout strap distance from pylon 924 is 1.4 feet. At $t_2$, 0.5 seconds after impact, strap 904 continues to deploy from both pylons 922 and 924 and the longitudinal distance traveled is 10.7 feet while the lateral distance traveled is 0.7 feet. Payout strap distance from pylon 922 is 2.9 feet while payout strap distance from pylon 924 is 4 feet. At $t_3$, approximately 0.75 seconds after impact, the force vehicle 902 applies to strap 904 has decreased enough that pylon 922 stops rotating. The longitudinal distance traveled is 13.3 feet while the lateral distance traveled is 1.8 feet. Payout strap distance from pylon 922 is 3.8 feet while payout strap distance from pylon 924 is 6.4 feet. Finally at $t_4$, approximately 1 second after impact, the vehicle comes to a stop after traveling a total longitudinal distance of 14 feet and a total lateral distance of 3.3 feet towards pylon 922. Payout strap distance from pylon 922 remains 3.8 feet as pylon 922 stopped deploying strap at $t_3$ while payout strap distance from pylon 924 has reached a total of 8.2 feet. The resulting deceleration path 920 is shown as a curved path.

Table 1 below summarizes the results of FIGS. 8 and 9.

TABLE 1

| | Torque Value (in-lbs) | | | | | | |
|---|---|---|---|---|---|---|---|
| | 30,000 Pylon and 48,000 Pylon | | | | | | |
| | | | 30,000 | 48,000 | Two 30,000 Pylons | | |
| Time Interval | Total Longitudinal Distance (ft) | Total Lateral Distance (ft) | Total Payout Strap Distance (ft) | Total Payout Strap Distance (ft) | Total Longitudinal Distance (ft) | Total Payout Strap Distance (ft) | Total Payout Strap Distance (ft) |
| $t_1$ | 6.4 | .1 | 1.4 | 1.2 | 6.6 | 1.4 | 1.4 |
| $t_2$ | 10.7 | .7 | 4 | 2.9 | 11.7 | 4 | 4 |
| $t_3$ | 13.3 | 1.8 | 6.4 | 3.8 | 15.3 | 6.4 | 6.4 |
| $t_4$ | 14 | 3.3 | 8.2 | 3.8 | 17.7 | 8.2 | 8.2 |

As can be seen from FIGS. 8 and 9 and from Table 1, the overall longitudinal distance from the pylons 818 when employing two pylons each set at 30,000 in-lbs is 17.7 feet. When employing a greater torque value of 48,000 in-lbs to pylon 922 and a lesser torque value of 30,000 in-lbs to pylon 924, the longitudinal distance 918 is reduced to 14 feet. The reduction from 17.7 feet to 14 feet is a reduction of 21%. Additionally the vehicle is redirected laterally a total of 3.3 feet towards pylon 922.

After impact, the strap may be rewound onto each spool by applying a rotational force to ratchet nut 104 which in turn rotates both the spool assembly and the spindle assembly. As shown in FIG. 1, this direction is clockwise. The clockwise rotation of the spool assembly unlocks and reverses ratchet plate 122 so both the spool assembly and the spindle assembly rotate during the rewinding of the strap. The spindle assembly and the spool assembly are held together by the friction between rotor plate 134 and brake disk 132 and the friction between brake disk 132 and spindle base plate 149 during the rewinding of the strap. Ratchet nut 104 is rotated until the strap is taut between two payout brakes 103 and 105.

In the preferred embodiments, payout brakes 103 and 105 are mirror images. The rotation of payout brake 103 is clockwise to deploy the payout strap and counterclockwise to spool the payout strap. The rotation of payout brake 105 is counterclockwise to deploy the payout strap and clockwise to spool the payout strap. In other embodiments, both pylons may employ a payout brake having the same rotational bias.

Figure 18:
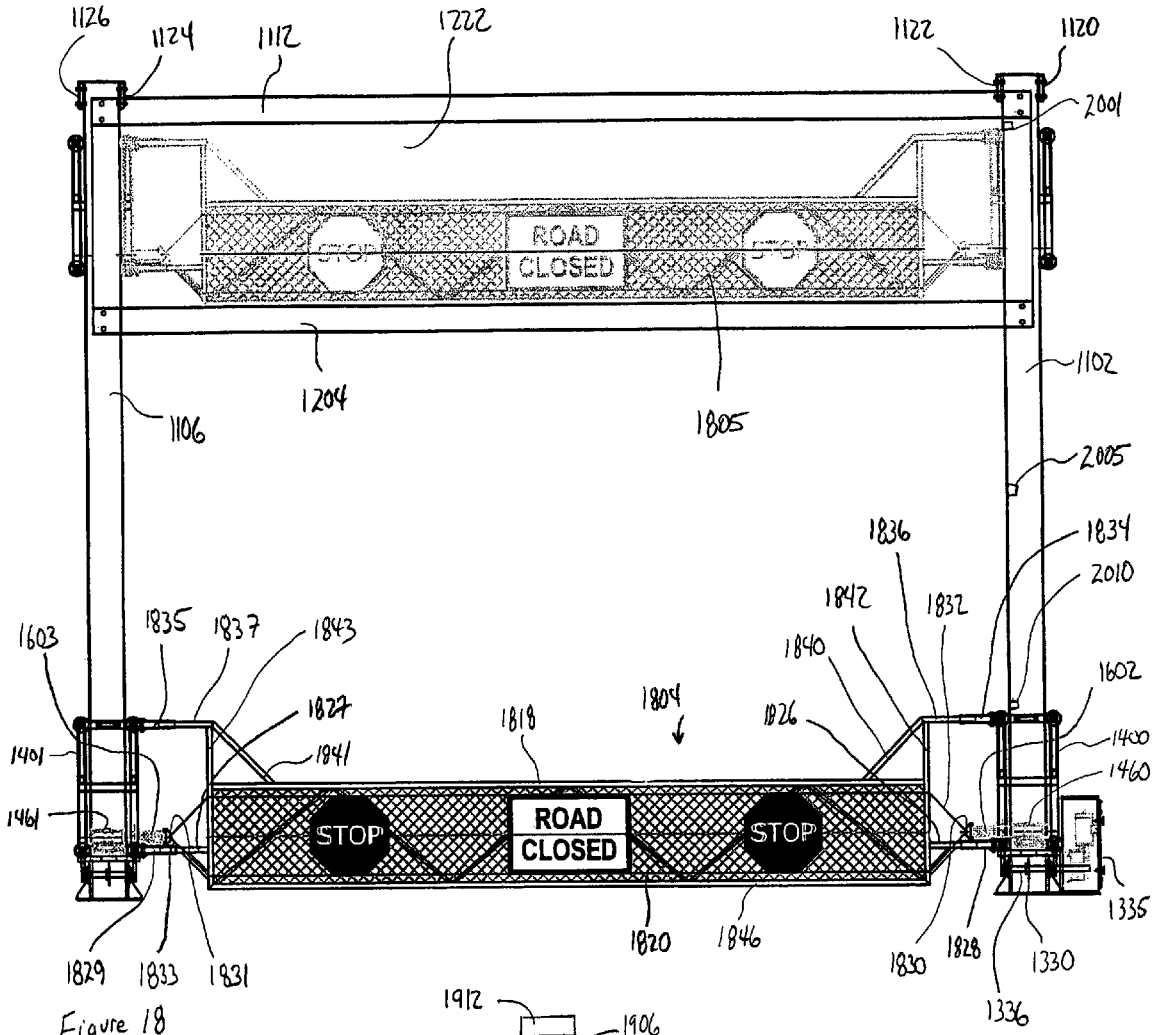
FIG. 18 is an elevation view of a gantry and a barrier of an alternate embodiment of the present invention.

An alternate embodiment of the present invention is shown in FIG. 18 where payout brakes 1460 and 1461 are mounted to payout brake carriages 1400 and 1401 respectively. Barrier 1804 is supported across a roadway or restricted entry point connected between the two payout brake carriages 1400 and 1401. Each payout brake carriage incorporates rollers and a counterweighted pulley system powered by an electric motor to raise and lower the carriages on a gantry as will be more fully described.

Figure 11:
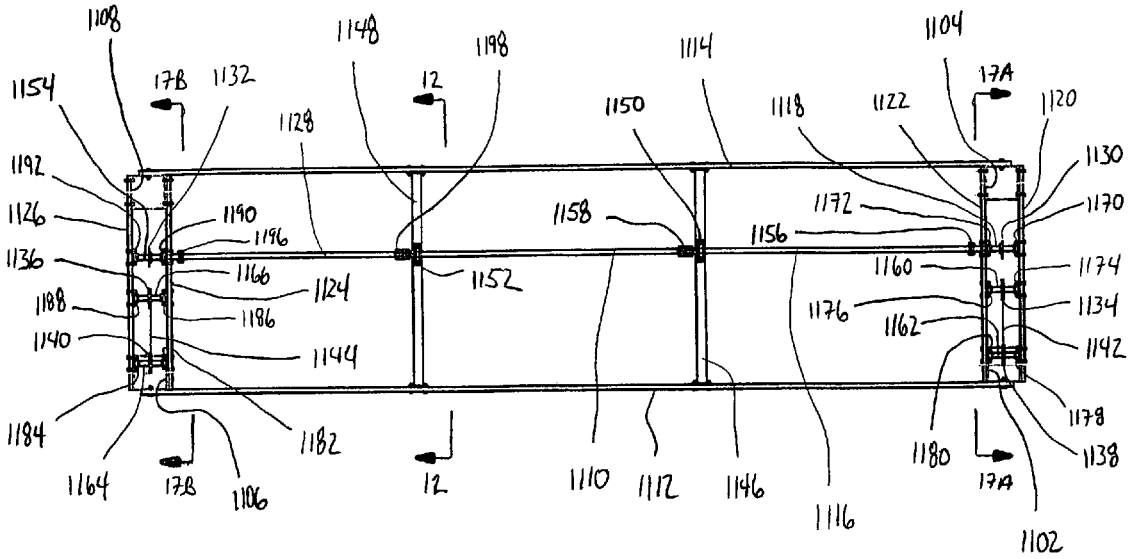
FIG. 11 is a plan view of a support structure of an alternate embodiment of the present invention.

FIG. 11 shows a top view of the gantry. The gantry comprises a box frame of columns and braces. Columns 1102, 1104, 1106, and 1108 each have a 14 inch hollow square cross-section formed from ¼ inch plate steel and range from 26 to 30 feet in height. Crossbars 1112 and 1114 are ¼ inch plate steel horizontal members spanning the distance over the roadway or restricted area. In the preferred embodiment, the maximum length the crossbars is 60 feet. Braces 1120, 1122, 1124, and 1126 are ¼ inch plate steel rectangular shaped members. Braces 1120 and 1122 connect columns 1102 and 1104 proximate the maximum height of the columns. Braces 1124 and 1126 connect columns 1106 and 1108 at the same height as braces 1120 and 1122. Crossbar 1112 connects column 1102 to column 1106. Crossbar 1114 connects column 1104 to column 1108.

Pulley shaft 1162 is rotationally connected between braces 1120 and 1122 and is supported by bearing blocks 1178 and 1180. Bearing block 1178 is mounted to brace 1120 and bearing block 1180 is mounted to brace 1122. The bearing blocks permit rotation of pulley shaft 1162 about its axis. Counterweight pulley 1138 is rigidly affixed to the midpoint of pulley shaft 1162. Pulley shaft 1160 connects between braces 1120 and 1122 and is supported by bearing blocks 1174 and 1176. Bearing block 1174 is mounted to brace 1120 while bearing block 1176 is mounted to brace 1122. Carriage pulley 1134 is fixed to the midpoint of pulley shaft 1160. Driveshaft segment 1118 is rotationally supported by bearing blocks 1170 and 1172. Bearing block 1170 is mounted to brace 1120 and bearing block 1172 is mounted to brace 1122. Driveshaft segment 1118 passes through brace 1122 and connects to driveshaft segment 1116 through coupling 1156. Sprocket 1130 is rigidly affixed to driveshaft segment 1118. Counterweight cable 1142 is supported by and guided by carriage pulley 1134 and counterweight pulley 1138.

On the opposite end of the gantry, pulley shaft 1164 is connected between braces 1124 and 1126 and is supported by bearing blocks 1182 and 1184. Bearing block 1182 is mounted to brace 1124 and bearing block 1184 is mounted to brace 1126. Counterweight pulley 1140 is affixed to pulley shaft 1164 equidistant between braces 1124 and 1126. Pulley shaft 1166 connects between braces 1124 and 1126 and is supported by bearing blocks 1186 and 1188. Bearing block 1186 is mounted to brace 1124 and bearing block 1188 is mounted to brace 1126. Carriage pulley 1136 is rigidly fixed at the midpoint of pulley shaft 1166. Driveshaft segment 1154 is rotationally supported by bearing blocks 1190 and 1192. Bearing block 1190 is mounted to brace 1124 and bearing block 1192 is mounted to brace 1126. Driveshaft segment 1154 passes through brace 1124 and connects to driveshaft segment 1128 through coupling 1196. Sprocket 1132 is rigidly affixed to driveshaft segment 1154. Counterweight cable 1144 is supported by and guided by carriage pulley 1136 and counterweight pulley 1140. Both counterweight cables 1142 and 1144 are ¼ inch plastic sheathed wire rope with a tensile strength ranging from 5,000 to 10,000 PSI. Each pulley shaft 1160, 1162, 1164, and 1166 is made of steel and is approximately 1 to 2 inches in diameter. Sprockets 1130 and 1132 are flat 17 tooth steel sprockets.

Driveshaft braces 1146 and 1148 connect perpendicularly between crossbars 1112 and 1114 and provide rigidity to the gantry. Bearing block 1150 is affixed to the top of driveshaft brace 1146. Bearing block 1152 is attached to driveshaft brace 1148. Drive shaft segment 1116 passes through bearing block 1150 and connects to driveshaft segment 1110 by coupling 1158. Driveshaft segment 1110 passes through bearing block 1152 and connects to driveshaft segment 1128 by coupling 1198. In the preferred embodiment, driveshaft segments 1118, 1116, 1110, 1128, and 1154 are high strength solid steel bar stock approximately 1 to 2 inches in diameter. In the preferred embodiment, the maximum total length of the combined driveshaft segments is approximately 60 feet. In an alternate preferred embodiment, the entire driveshaft is one solid length rod capable of spanning the distance between brace 1120 and brace 1126.

Figure 12:
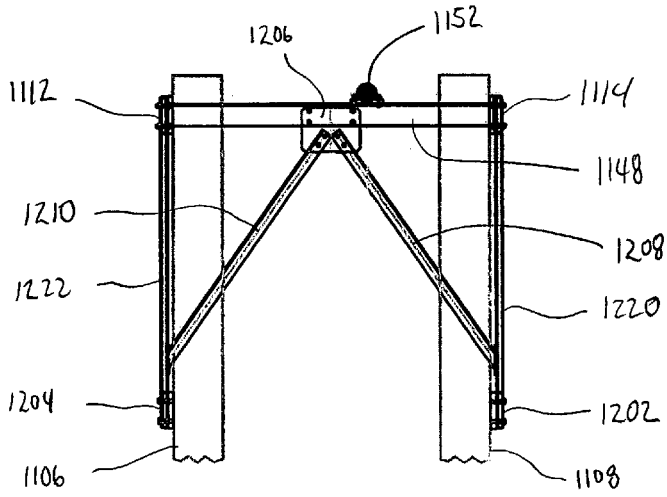
FIG. 12 is a partial elevation view of a support structure of an alternate embodiment of the present invention along line 12-12 of FIG. 11.

FIG. 12 shows a section view of gantry from the side at 12-12. Crossbar 1204 connects column 1102 to column 1106. At the same vertical height as crossbar 1204, crossbar 1202 connects between columns 1104 and 1108. Attached to crossbars 1112 and 1204 is covering 1222. Attached between crossbars 1114 and 1202 is covering 1220. In the preferred embodiment, both coverings 1220 and 1222 are generally rectangular shaped sheet metal that span the distance between columns 1102 and 1106 and 1104 and 1108 respectively and offer covering and weather protection for the working components of the gantry. Connector plate 1206 is secured to the approximate center of driveshaft brace 1148 to provide a mounting position for reinforcements 1208 and 1210. Connector plate 1206 is rectangular shaped ¼ inch plate steel with dimensions of approximately 15 inches by 10 inches. Reinforcements 1208 and 1210 are connected to connector plate 1206 on one end and to coverings 1220 and 1222 respectively on the other. In the preferred embodiment, reinforcements 1208 and 1210 are 2 inch channel stock affixed at approximately a 45° angle. Additional 45° reinforcements (not shown) are connected between coverings 1220 and 1222 and a connector plate attached to driveshaft brace 1146.

Figure 13A:
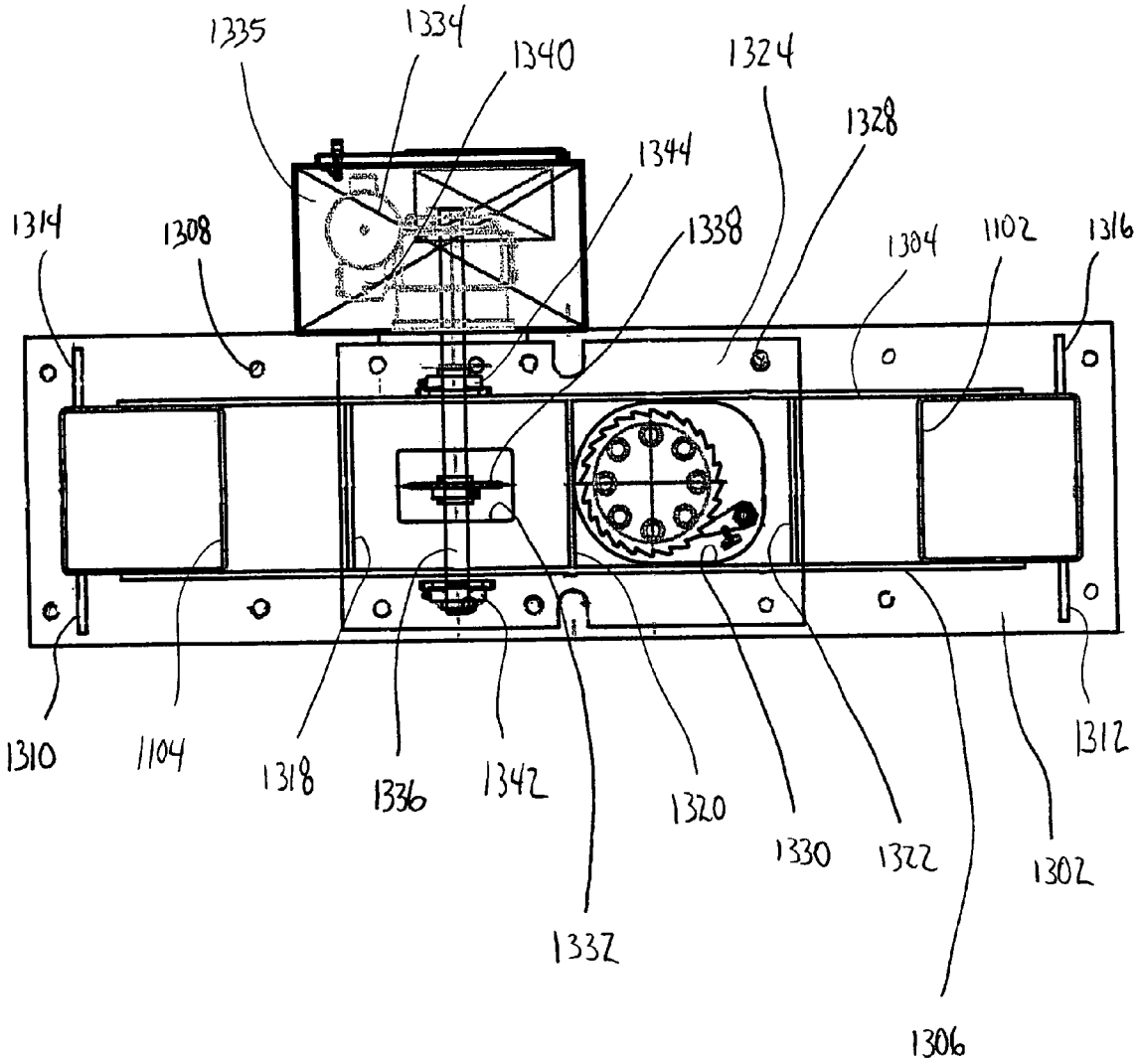
FIG. 13A is a plan view of the base of a support structure of an alternate embodiment of the present invention along line 13A-13A of FIG. 17A.
Figure 17A:
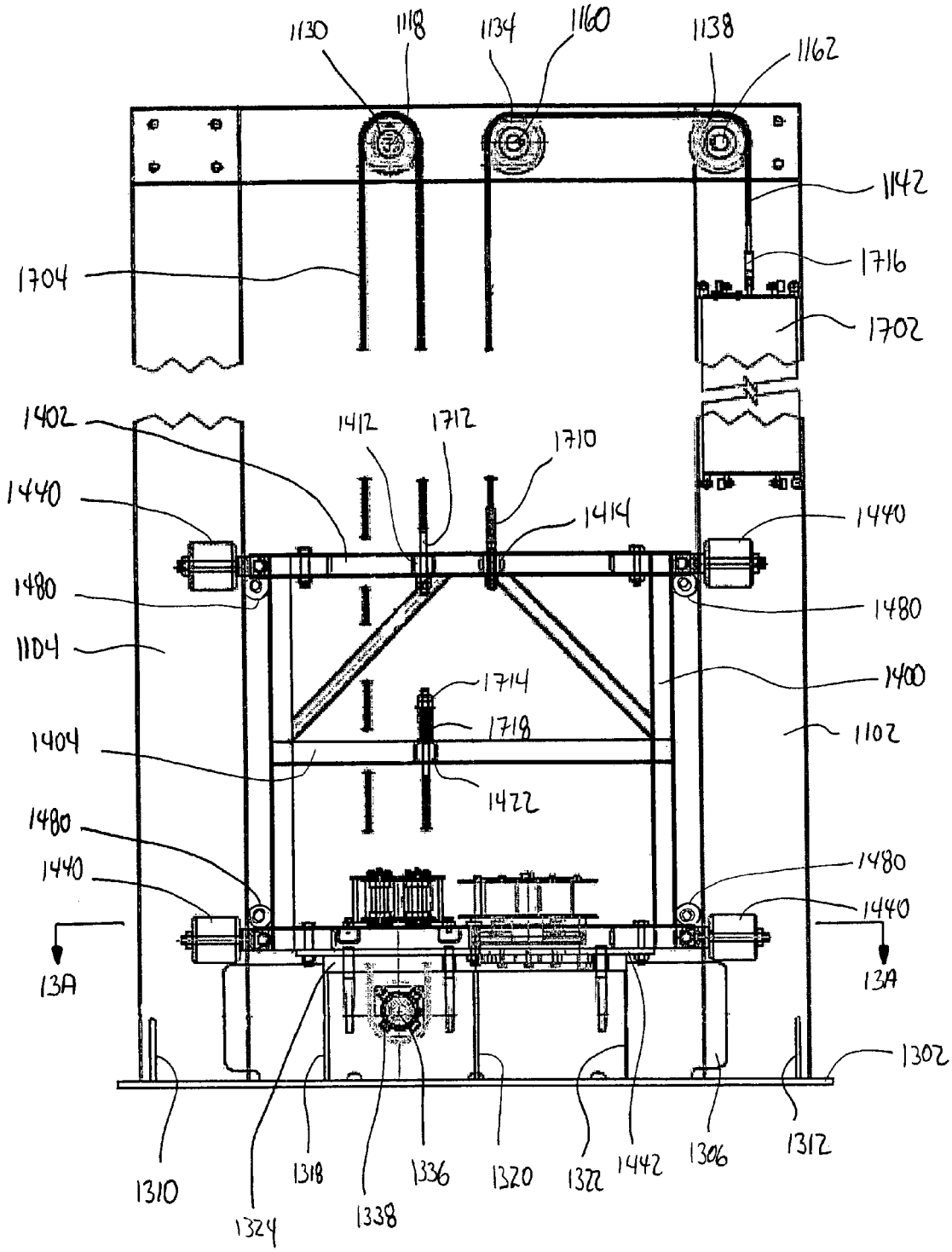
FIG. 17A is a partial elevation view of a payout brake carriage mounted to a support structure of an alternate embodiment of the present invention along line 17A-17A of FIG. 11.

As shown best in FIGS. 13A and 17A, columns 1102 and 1104 are connected to each other by joists 1304 and 1306 and base 1302. Each joist is adjacent and welded to opposing parallel surfaces of each column 1102 and 1104. Joists 1304 and 1306 are generally rectangular shaped ¼ inch plate steel approximately seven feet in length and extending perpendicularly from base 1302 approximately 14 inches. Columns 1102 and 1104 and joists 1304 and 1306 are affixed to base 1302. Base 1302 is a rectangular shaped, ¼ inch steel plate. Base 1302 is anchored to a concrete pad. In the preferred embodiment, a four foot deep concrete pier is provided reinforced with steel, to serve as a mounting surface for base 1302. A plurality of equally spaced anchor holes 1308 are provided to secure base 1302 to a concrete pad underneath. In the preferred embodiment, base 1302 is 94 inches in length and 26 inches in width.

Additionally, each column has two buttresses extending from opposing surfaces parallel to the width of base 1302. Buttresses 1310 and 1314 extend from column 1104 and are additionally affixed to base 1302. Buttresses 1312 and 1316 extend from column 1102 and are also connected to base 1302. Buttresses 1310, 1312, 1314, and 1316 are triangular shaped flanges integrally formed with or welded to base 1302 and columns 1102 or 1104. Also connected to base 1302 and joists 1304 and 1306 are ribs 1318, 1320, and 1322. Ribs 1318, 1320, and 1322 are oriented parallel to the buttresses and perpendicular to the joists and extend at right angles from base 1302.

The combination of base 1302, joists 1304 and 1306, and ribs 1318, 1320, and 1322 provide a support frame for foundation plate 1324. Sitting atop and welded to the joists and the ribs is foundation plate 1324. Foundation plate 1324 is a rectangular shaped steel member approximately ¾ to 1½ inches thick. Foundation plate 1324 includes a plurality of anchor holes 1328 around its perimeter. Additionally, foundation plate 1324 defines chain hole 1332 and payout brake hole 1330. Chain hole 1332 is a rectangular shaped opening centered on the longitudinal center axis of foundation plate 1324. Payout brake hole 1330 is sized to accommodate the ratchet plate and the ratchet and pawl mechanism of payout brake 1460.

Motor case 1335 is attached to base 1302 and foundation plate 1324 by a weld or with bolts common in the art. Motor case 1335 houses motor 1334 and transmission 1340. Extending from motor 1334 is shaft 1336. Motor 1334 in the preferred embodiment is a 220 volt ½ horsepower motor including a transmission with an output shafts speed of about 30 RPM maximum. Shaft 1336 passes through joists 1304 and 1306 and is supported by bearing blocks 1342 and 1344. The bearing blocks permit rotation of the shaft about its axis. Securely affixed to shaft 1336 and located in cooperation with chain hole 1332 is drive gear 1338. Drive gear 1338 is a flat 45 tooth sprocket.

Figure 13B:
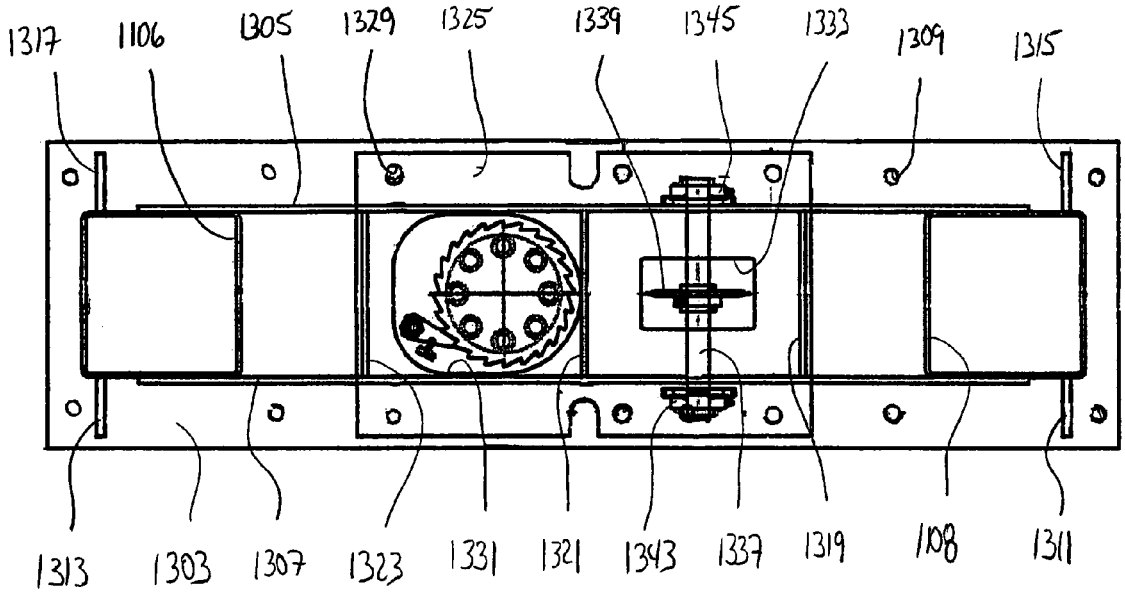
FIG. 13B is a plan view of the base of a support structure of an alternate embodiment of the present invention along line 13B-13B of FIG. 17B.
Figure 17B:
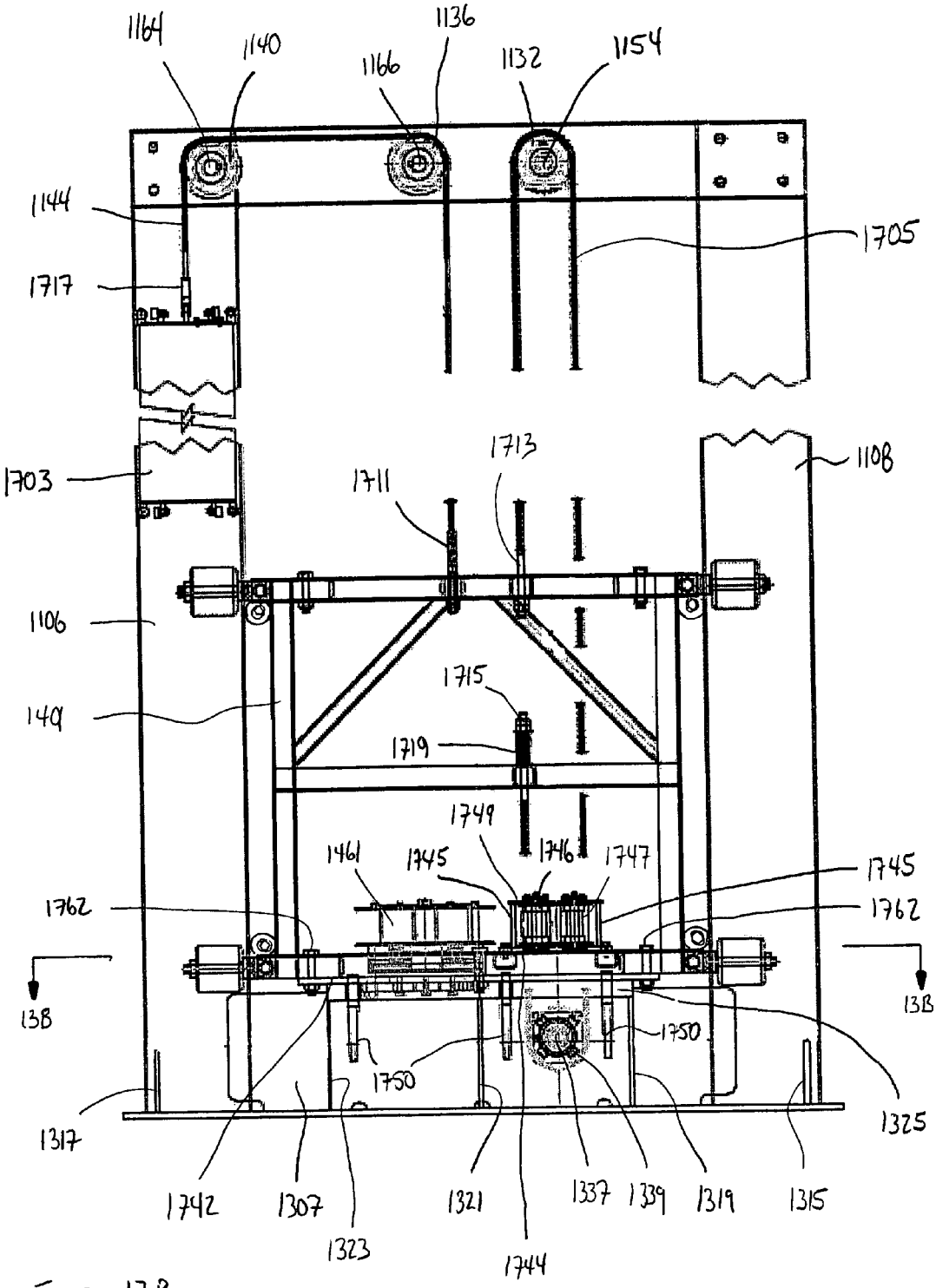
FIG. 17B is a partial elevation view of a payout brake carriage mounted to a support structure of an alternate embodiment of the present invention along line 17B-17B of FIG. 11.

FIGS. 13B and 17B show the opposite side of the gantry. Columns 1106 and 1108 are connected to each other by joists 1305 and 1307 and base 1303. Each joist is adjacent and welded to opposing parallel surfaces of each column 1106 and 1108. Joists 1305 and 1307 extend perpendicularly from base 1302. Columns 1106 and 1108 and joists 1305 and 1307 are affixed to base 1303. Base 1303 is anchored to a concrete pad. A plurality of equally spaced anchor holes 1309 are provided to secure base 1303 to the concrete pad underneath.

Each column has two buttresses extending from opposing surfaces parallel to the width of base 1303. Buttresses 1311 and 1315 extend from column 1108 and are additionally affixed to base 1303. Buttresses 1313 and 1317 extend from column 1106 and are also connected to base 1303. Buttresses 1311, 1313, 1315, and 1317 are triangular shaped flanges integrally formed with or welded to base 1303 and columns 1108 or 1106. Also connected to base 1303 and joists 1305 and 1307 are ribs 1319, 1321, and 1323. Ribs 1319, 1321, and 1323 are oriented parallel to the buttresses and perpendicular to the joists and extend at right angles from base 1303.

The combination of base 1303, joists 1305 and 1307, and ribs 1319, 1321, and 1323 provide a support frame for foundation plate 1325. Sitting on top of and welded to the joists and the ribs is foundation plate 1325. Foundation plate 1325 includes a plurality of anchor holes 1329 around its perimeter. Additionally, foundation plate 1325 defines chain hole 1333 and payout brake hole 1331. Chain hole 1333 is a rectangular shaped opening centered on the longitudinal center axis of foundation plate 1325. Payout brake hole 1331 is sized to accommodate the ratchet plate and the ratchet and pawl mechanism of payout brake 1461.

Sprocket shaft 1337 passes through joists 1305 and 1307 and is supported by bearing blocks 1343 and 1345. The bearing blocks permit rotation of the shaft about its axis. Securely affixed to sprocket shaft 1337 and located in cooperation with chain hole 1333 is sprocket 1339. Sprocket 1339 is a flat 45 tooth sprocket.

Figure 14:
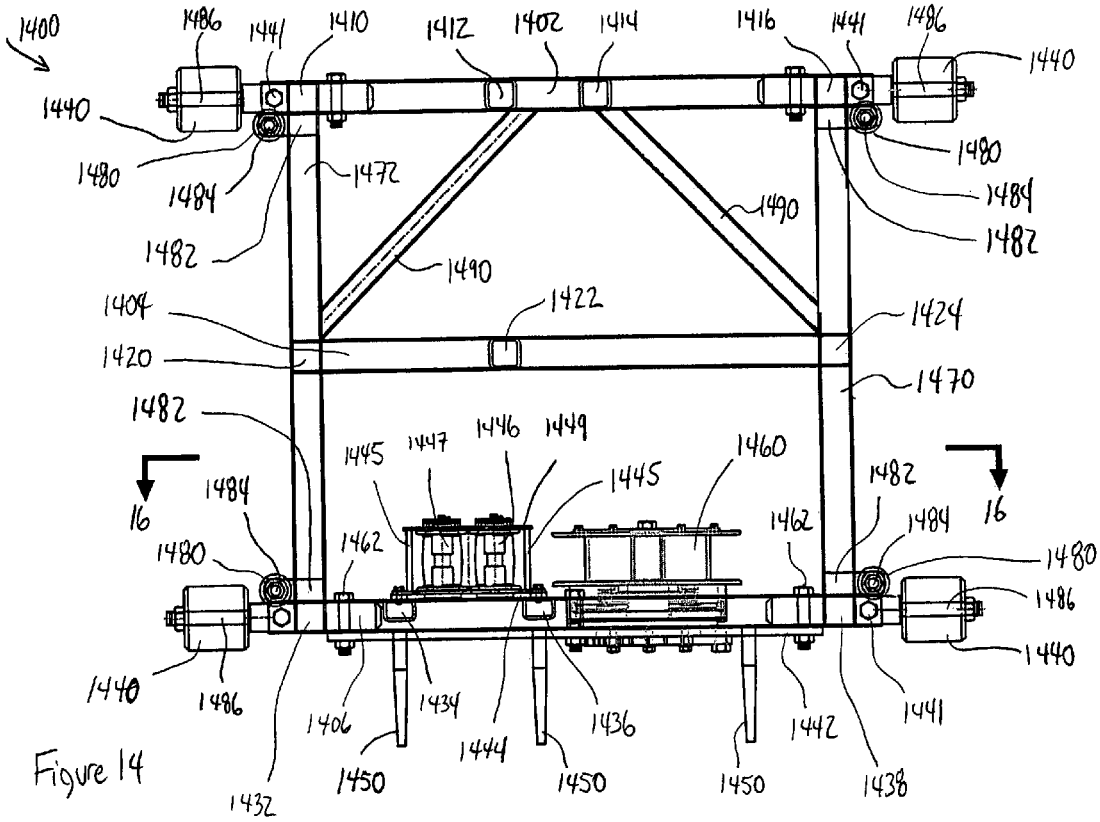
FIG. 14 is an elevation view of a payout brake carriage of an alternate embodiment of the present invention.
Figure 15:
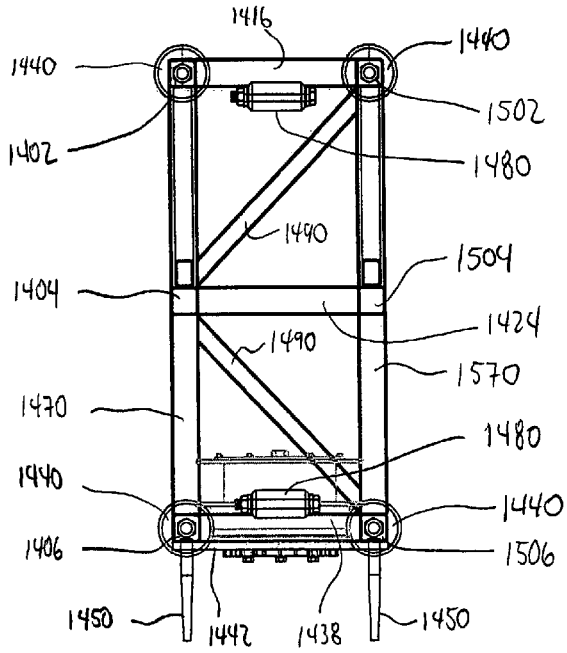
FIG. 15 is an elevation view of a payout brake carriage of an alternate embodiment of the present invention.
Figure 16:
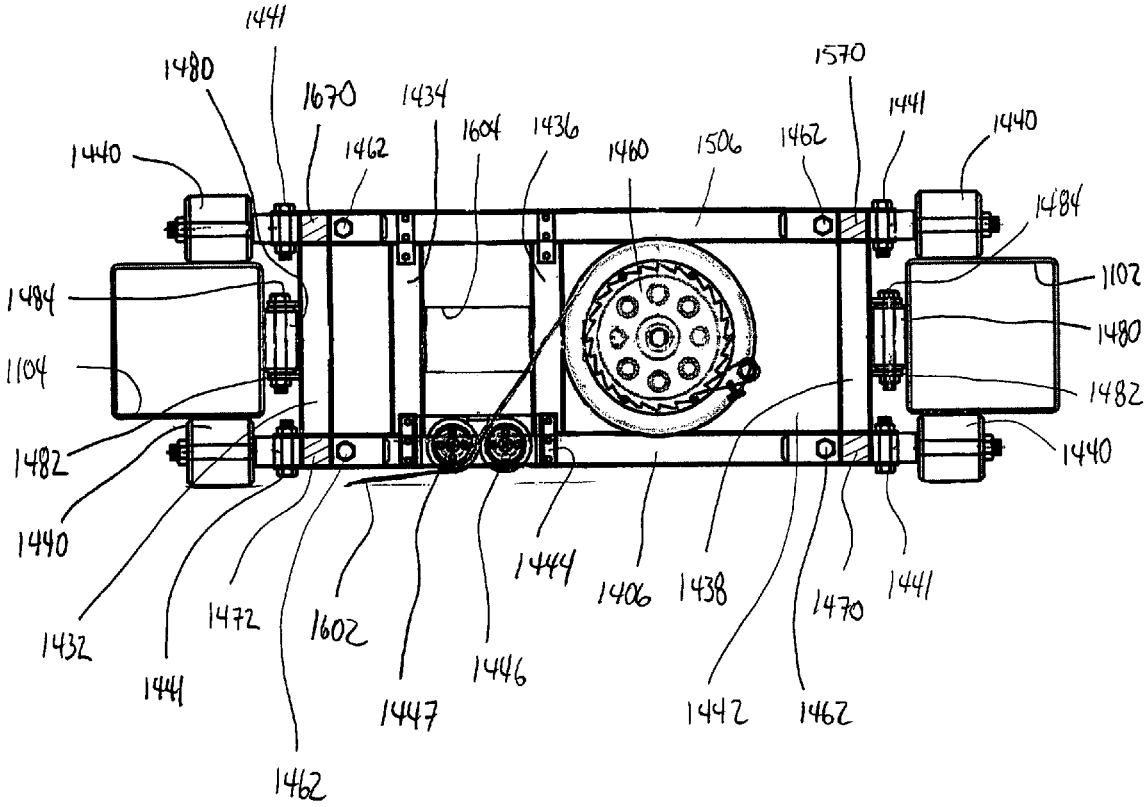
FIG. 16 is a plan view of a payout brake carriage adjacent two columns of a support structure of an alternate embodiment of the present invention along line 16-16 of FIG. 14.

As shown in FIGS. 14, 15, and 16, payout brake carriage 1400 is a six-sided, rectangular shaped rolling sled made from 2 inch square steel tubing. Payout brake carriage 1400 includes vertical posts 1470, 1472, 1570, and 1670. The vertical posts are connected by base cross members 1406 and 1506, mid cross members 1404 and 1504, and cross members 1402 and 1502 located at the base, the midpoint, and the top of the vertical posts respectively. Connecting horizontally between each pair of cross members is a plurality of struts. Struts 1410, 1412, 1414 and 1416 connect cross members 1402 and 1502. Struts 1420, 1422, and 1424 connect mid cross members 1404 and 1504. Struts 1432, 1434, 1436, and 1438 span the distance between base cross members 1406 and 1506. Payout brake carriage 1400 further includes a plurality of diagonal support members 1490 connecting between various cross members at approximate 45° angles.

Each end of cross members 1402 and 1502 and base cross members 1406 and 1506 extend past the four vertical posts to provide a mounting point for each primary roller 1440. Primary rollers 1440 are made of polyurethane and have a diameter ranging between four and six inches. Primary rollers 1440 include sealed bearings for pivotal support on roller axles 1486. Each roller axle 1486 extends from a square shaped base affixed to the hollow ends of the cross members by a roller mounting bolt 1441. Four primary rollers of payout brake carriage 1400 are adjacent column 1102 and four primary rollers are adjacent column 1104. Payout brake carriage 1400 includes (4) four secondary rollers 1480. Roller brackets 1482 provide mounting positions for each secondary roller 1480 on four struts of payout brake carriage 1400. Roller brackets 1482 are integrally formed with or welded to struts 1410, 1416, 1432, and 1438 and position each secondary roller 1480 adjacent to the columns. A roller mounting bolt 1484 attaches each secondary roller 1480 to a roller bracket 1482. Secondary rollers 1480 include sealed bearings for pivotal support on the roller mounting bolts. Secondary rollers 1480 are made of polyurethane and have a diameter of approximately 2 inches. Primary rollers 1440 prevent lateral movement of the payout brake carriage with respect to the columns and secondary rollers 1480 ensure against longitudinal movement of the payout brake carriage with respect to the columns.

Carriage base plate 1442 is a rectangular, plate steel member approximately ¼ inch thick mounted to the underside of payout brake carriage 1400 by a plurality of base plate bolts 1462. Carriage base plate 1442 includes base plate hole 1604. Base plate hole 1604 is rectangular in shape and concentric with chain hole 1332 of foundation plate 1324. Roller plate 1444 is a rectangular shaped member mounted to payout brake carriage 1400 on struts 1434 and 1436. Roller plate 1444 provides a mounting surface for payout strap rollers 1446 and 1447. The distance between payout strap rollers 1446 and 1447 is adjustable to accommodate varying thicknesses of payout strap 1602. Payout strap rollers 1446 and 1447 are four inch polished steel or chrome cylinders pivotally mounted on sealed bearings. The sealed bearings are mounted on bolts passing through the center of each payout strap roller. Payout strap rollers 1446 and 1447 are positioned adjacent one another and provide a guide for payout strap 1602 as it is unwound from payout brake 1460. Supports 1445 connect between roller plate 1444 and roller plate 1449. Additionally, a plurality of anchors 1450 are attached to the underside of carriage base plate 1442. Anchors 1450 are cylindrical members approximately ½ to 1 inch in diameter and approximately 12 inches long.

FIGS. 16 and 17A show payout brake carriage 1400 mounted between columns 1102 and 1104 on primary rollers 1440 and secondary rollers 1480. One end of counterweight cable 1142 is attached to payout brake carriage 1400 in the center of strut 1414 with cable bolt 1710 and a washer. The opposite end of counterweight cable 1142 after passing over carriage pulley 1134 and counterweight pulley 1138 is connected to counterweight 1702 by cable bolt 1716 and a washer. Counterweight 1702 is suspended by counterweight cable 1142 inside the hollow column 1102. Counterweight 1702 is preferably made of lead contained in a smooth Teflon casing, but could just as easily be cast iron or concrete. To reduce the power requirements of motor 1334, counterweight 1702 weighs approximately the same as the combined weight of payout brake carriage 1400 and half of barrier 1804. In the preferred embodiment, counterweight 1702 weighs 500 pounds.

Roller chain 1704 is a series of connected links formed from high strength steel and constructed as is common in the art. In the preferred embodiment, the roller chain is ANSI 80 single pitch roller chain capable of transmitting about three horsepower. One end of roller chain 1704 is attached to payout brake carriage 1400 in the center of strut 1412 with cable bolt 1712. Roller chain 1704 is engaged and supported by sprocket 1130. The roller chain traverses the cross members of payout brake carriage 1400; base plate hole 1604; chain hole 1332; and engages drive gear 1338. On return, the roller chain traverses the foundation plate, the carriage base plate, and the base cross members. The roller chain is attached to payout brake carriage 1400 at strut 1422. Bolt 1714 passes through strut 1422 and is linked to roller chain 1704. Spring 1718 acts a shock absorber and surrounds bolt 1714. The links in roller chain 1704 are sized to mesh with the teeth of drive gear 1338 and sprocket 1130.

Referring again to FIG. 17B, payout brake carriage 1401 is shown adjacent columns 1106 and 1108. Carriage base plate 1742 is mounted to the underside of payout brake carriage 1401 by a plurality of base plate bolts 1762. Roller plate 1744 is mounted to payout brake carriage 1401 and provides a mounting surface for payout strap rollers 1746 and 1747. Payout strap rollers 1746 and 1747 are positioned adjacent one another and provide a guide for payout strap 1603 as it is unwound from payout brake 1461. A plurality of supports 1745 are positioned proximate the corners of roller plate 1744 and connect roller plate 1744 to roller plate 1749. Additionally, a plurality of cylindrically shaped anchors 1750 are attached to the underside of carriage base plate 1742.

One end of counterweight cable 1144 is attached to payout brake carriage 1401 with cable bolt 1711 and a washer. The opposite end of counterweight cable 1144 after passing over carriage pulley 1136 and counterweight pulley 1140 is connected to counterweight 1703 by cable bolt 1717 and a washer. Counterweight 1703 hangs on counterweight cable 1144 inside hollow column 1106.

One end of roller chain 1705 is attached to payout brake carriage 1401 with cable bolt 1713. Roller chain 1705 is engaged and supported by sprocket 1132. The roller chain traverses the cross members of payout brake carriage 1401 and engages sprocket 1339. The other end of roller chain 1705 is attached to payout brake carriage 1401 with bolt 1715. Bolt 1715 is surrounded by spring 1719. The links in roller chain 1705 are sized to mesh with the teeth of sprockets 1132 and 1339.

FIG. 18 shows barrier 1804 in a lowered position. Barrier 1804 is positioned between payout brake carriages 1400 and 1401. A ghosted version, barrier 1805 is shown in the raised position hidden from view by covering 1222. In the preferred embodiment, barrier 1804 includes chain link style fencing wire made of zinc plated steel. The barrier may carry signs or traffic signals. Barrier 1804 further comprises barrier frame member 1818 perpendicularly connected to barrier posts 1842 and 1843. Barrier posts 1842 and 1843 also connect perpendicularly to barrier frame member 1846. Barrier frame member 1818, barrier post 1842, barrier post 1843, and barrier frame member 1846 are 1 to 2 inch square extruded aluminum tubing. The tubing is thin walled and designed to be sacrificial in the case of a vehicle impact.

Barrier support arms 1826 and 1836 are horizontal members connected to barrier post 1842 that extend perpendicular to barrier post 1842 and are seated within carriage sleeves 1828 and 1834 respectively. Barrier support arms 1827 and 1837 are horizontal members connected to barrier post 1843 that extend perpendicular to barrier post 1843 and are seated within carriage sleeves 1829 and 1835 respectively. Brace 1840 is connected at an approximate 45° angle between barrier frame member 1818 and the intersection of barrier post 1842 and barrier support arm 1836. Brace 1841 is connected at an approximate 45° angle between barrier frame member 1818 and the intersection of barrier post 1843 and barrier support arm 1837. Ribbon support 1820 is a 1 to 2 inch wide nylon or polyester belt that connects barrier frame member 1818 and barrier frame member 1846 at approximate 45° angles through a series of slots (not shown) in each barrier frame member. Ribbon support 1820 attaches to barrier support arms 1826 and 1827. In an alternate preferred embodiment, barrier 1804 is supported by a plurality of equally spaced vertical steel support posts. In an additional alternate embodiment, barrier 1804 is nylon netting with plastic support posts.

Carriage sleeves 1828 and 1834 are connected to and extend perpendicularly towards barrier 1804 from payout brake carriage 1400. Carriage sleeves 1828 and 1834 are concentrically aligned with and have a slightly larger cross section than barrier support arms 1826 and 1836. Carriage sleeves 1829 and 1835 are connected to and extend perpendicularly towards barrier 1804 from payout brake carriage 1401. Carriage sleeves 1829 and 1835 are concentrically aligned with and have a slightly larger cross section than barrier support arms 1827 and 1837. The barrier support arms fit telescopically inside of the carriage sleeves.

Figure 19:
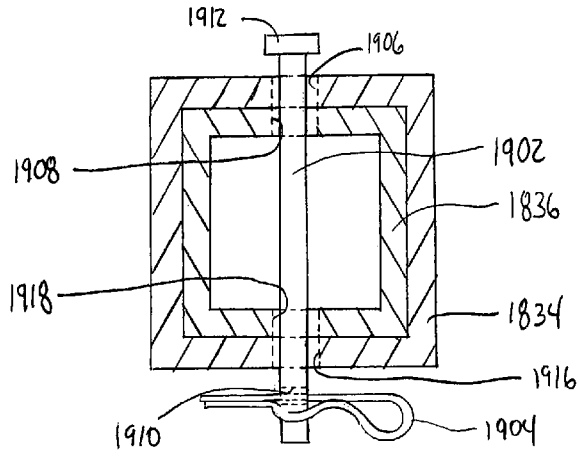
FIG. 19 is cross-section view of a connection of an alternate embodiment of the present invention.

FIG. 19 illustrates a cross-section of barrier support arm 1836 inside carriage sleeve 1834. Shear bolt 1902 fits through the concentrically aligned attachment holes 1906 and 1916 of carriage sleeve 1834 and attachment holes 1908 and 1918 of barrier support arm 1836. Attachment holes 1906 and 1908 are approximately ¼ inch in diameter. Head 1912 is located on an end of shear bolt 1902 and prevents shear bolt 1902 from passing completely through attachment holes 1906 and 1908. Shear bolt is made of aluminum and is approximately ⅛ inch in diameter. Cotter pin 1904 fits through pin hole 1910 located proximate the opposite end of shear bolt 1902 and prevents shear bolt 1902 from moving.

Payout strap 1602 is wound in the channel of payout brake 1460 and connected to barrier 1804 by tension wires 1832 and 1833 and D-ring 1830. Payout strap 1602 passes through D-ring 1830 and securely affixed onto itself. Tension wires 1832 and 1833 are clipped onto D-ring 1830 and interwoven through the length of barrier 1804. Tension wire 1832 runs parallel to and adjacent to barrier frame member 1818. Tension wire 1833 runs parallel to and adjacent to barrier frame member 1846. Payout strap 1603 is wound in the channel of payout brake 1461 and connected to barrier 1804 by tension wires 1832 and 1833 and D-ring 1831. Payout strap 1603 passes through D-ring 1831 and securely affixed to itself. Tension wires 1832 and 1833 are clipped onto D-ring 1831. In the preferred embodiment, tension wires 1832 and 1833 are ½ inch diameter carbon steel wire rope with a tensile strength ranging from 100,000 PSI to 200,000 PSI.

Barrier 1804 moves between a raised position and a lowered position on the gantry. A series of limit switches 2001, 2005 and 2010 is provided adjacent column 1102 that are triggered by the passage payout brake carriage 1400. The series of limit switches provides a set of control signals to the controller allowing an adjustment of the height of the barrier. In the preferred embodiment, there are 3 settings to the adjustment, lowered, medium and raised. Of course, those skilled in the art will recognize that controllers of different configurations can be employed to set the barrier height at any number of height adjustments. The height adjustments provide a means to position the barrier to accommodate differing vehicle heights. As an example, the medium height adjustment in the preferred embodiment is 55 inches from the road surface in order to accommodate the height of the center of gravity for a semi-tractor trailer. In the lowered position, the barrier is positioned at 36 inches to intercept a standard automobile at its center of gravity and safely decelerate it. In the raised position, in the preferred embodiment, 16 feet, most vehicles may pass under the barrier unimpeded. Also in the raised position, covering 1222 conceals from motorists any signage that may be affixed to barrier 1804. Barrier 1805, a ghosted version of barrier 1804, shows the location of the barrier in a raised position.

To move barrier 1804 into a lowered position and restrict entry, a switch on a control panel (not shown) activates motor 1334. Motor 1334 turns shaft 1336 which rotates drive gear 1338. Drive gear 1338 advances roller chain 1704. Roller chain 1704, attached to payout brake carriage 1400 by bolt 1714 which, in turn, initiates movement of payout brake carriage 1400 down columns 1102 and 1104. Spring 1718 surrounding bolt 1714 absorbs the sudden shock of initial movement and accommodates any slack in roller chain 1704. Payout brake carriage 1400 and connected barrier 1804 are lowered into place until a limit switch turns off the motor. As payout brake carriage 1400 is lowered, the attached counterweight cable 1142 that is supported and guided by carriage pulley 1134 and counterweight pulley 1138 simultaneously raises counterweight 1702 inside the hollow column 1102. Counterweight 1702 offsets the combined weight of payout brake carriage 1400 and a portion of barrier 1804.

While lowering payout brake carriage 1400, roller chain 1704 simultaneously turns sprocket 1130. The rotation of sprocket 1130 also rotates the coupled driveshaft segments 1118, 1116, 1110, 1128, and 1154. The rotation of driveshaft segment 1154 turns sprocket 1132 positioned above payout brake carriage 1401. Roller chain 1705 is advanced by sprocket 1132. Roller chain 1705 simultaneously rotates sprocket 1339 and is connected to payout brake carriage 1401 by bolt 1715. Spring 1719 surrounding bolt 1715 absorbs the shock of initial movement and keeps roller chain 1705 taut. The result is payout brake carriage 1401 which is connected to the opposite side of barrier 1804 is simultaneously lowered with payout brake carriage 1400. As payout brake carriage 1401 is lowered, the attached counterweight cable 1144 that is supported and guided by carriage pulley 1136 and counterweight pulley 1140 simultaneously raises counterweight 1703 inside the hollow column 1106. Counterweight 1703 offsets the combined weight of payout brake carriage 1401 and a portion of barrier 1804. Payout brake carriage 1400 is lowered until the limit switch is reached shutting off the motor and carriage base plate 1442 becomes adjacent to and rests on foundation plate 1324.

Plurality of anchors 1450 passes through foundation plate 1324 via plurality of aligned anchor holes 1308. Combined with primary rollers 1440 and secondary rollers 1480 adjacent columns 1102 and 1104, anchors 1450 extending through anchor holes 1308 secure payout brake carriage 1400 to the anchored support structure should a vehicle impact the barrier. On the opposite end of barrier 1804 and rolling adjacent to columns 1106 and 1108, payout brake carriage 1401 is simultaneously lowered until carriage base plate 1742 rests on foundation plate 1325. Plurality of anchors 1750 pass through and become seated in anchor holes 1309.

To move barrier 1804 to a raised position, a switch on the control panel (not shown) provides electrical current to motor 1334. Motor 1334 turns shaft 1336 which rotates drive gear 1338. Drive gear 1338 advances roller chain 1704. Roller chain 1704, attached to payout brake carriage 1400 advances movement of payout brake carriage 1400 up columns 1102 and 1104. The weight of counterweight 1702 supported and guided by carriage pulley 1134 and counterweight pulley 1138 offsets the weight of payout brake carriage 1400 and barrier 1804 and assists motor 1334 in initiating movement of payout brake carriage 1400 and the connected barrier 1804. As payout brake carriage 1400 is raised, the attached counterweight cable 1142 lowers counterweight 1702 inside the hollow column 1102. Payout brake carriage 1400 and barrier 1804 are raised until a limit switch turns off the motor. Covering 1222 keeps barrier 1804 hidden from view when in the raised position.

The rotation of sprocket 1130 rotates the coupled driveshaft segments 1118, 1116, 1110, 1128, and 1154. The rotation of driveshaft segment 1154 turns sprocket 1132 positioned above payout brake carriage 1401. Roller chain 1705 is advanced by sprocket 1132. Roller chain 1705 simultaneously rotates sprocket 1339 and is connected to payout brake carriage 1401. The result is payout brake carriage 1401 which is connected to the opposite side of barrier 1804 is simultaneously raised with payout brake carriage 1400. The weight of counterweight 1703 supported and guided by carriage pulley 1136 and counterweight pulley 1140 offsets the weight of payout brake carriage 1401 and barrier 1804. As payout brake carriage 1401 is raised, the attached counterweight cable 1144 lowers counterweight 1703 inside the hollow column 1106. The weight of counterweight 1703 offsets the combined weight of payout brake carriage 1401 and a portion of barrier 1804. Payout brake carriage 1401 and barrier 1804 are raised until a limit switch turns off the motor.

Upon impact by a vehicle, because of the sacrificial design of barrier 1804, barrier 1804 is deformed and conforms to the shape of the front of the moving vehicle. The shear bolts connecting barrier support arms 1826, 1827, 1836, and 1837 to carriage sleeves 1828, 1829, 1834, and 1835 shear through barrier support arms releasing them from the carriage sleeves. Because tension wires 1832 and 1833 are interwoven within barrier 1804 and are connected to payout straps 1602 and 1603, the barrier conforms easily and quickly to the vehicle. Payout straps 1602 and 1603 begin to deploy from payout brakes 1460 and 1461 respectively. Both payout straps will deploy at the same rate if the torque values of the payout brakes are equal resulting in a linear deceleration path. If one payout brake has a lesser torque setting, the deceleration path will be curvilinear as previously described.

Payout strap rollers 1446 and 1447 mounted between roller plates 1444 and 1449 on payout brake carriage 1400 provide a pivot point for payout strap 1602 as payout strap 1602 is deployed from payout brake 1460. Payout strap rollers 1446 and 1447 and roller plates 1444 and 1449 guide payout strap 1602 as it is deployed from payout brake 1460. On the opposite side of the gantry, payout strap rollers 1746 and 1747 mounted between roller plates 1744 and 1749 on payout brake carriage 1401 provide a pivot point and act as a guide for payout strap 1603 as payout strap 1603 is deployed from payout brake 1461.

After impact, the barrier may be easily and inexpensively reformed or replaced and reconnected to the payout straps without difficulty. As previously described, the payout straps are rewound in the channel of each payout brake by rotating the ratchet nut.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. An adjustable brake for a collision strap comprising:

a spindle assembly pivotally mounted in a mounting plate;

a lower caliper disk, rigidly attached to the spindle assembly;

an upper caliper disk assembly, axially adjustable and rotationally fixed with respect to the spindle assembly;

a rotational bias means, operationally attached between the spindle assembly and the mounting plate, for facilitating rotation of the spindle assembly with respect to the mounting plate in a first rotational direction and preventing rotation of the spindle assembly with respect to the mounting plate in a second rotational direction;

a spool assembly, axially aligned with and rotationally mounted on the spindle assembly;

a brake disk, rigidly attached to the spool assembly;

an upper brake lining disk, adjacent the upper caliper disk assembly and the brake disk;

a lower brake lining disk, adjacent the lower caliper disk and the brake disk; and a spool channel, rigidly connected to the spool assembly, for spooling the collision strap when the spool assembly is rotated in the first rotational direction and for facilitating adjustable payout tension of the collision strap when the spool assembly is rotated in the second rotational direction by the collision strap.

2. The adjustable brake of claim 1 wherein the rotational bias means further comprises:

a circular ratchet surface connected to and concentrically aligned with the spindle assembly; and a pawl assembly fixed to the mounting plate and operationally engaged with the circular ratchet surface.

3. The adjustable brake of claim 1 wherein the rotational bias means further comprises:

a circular ratchet surface integrally formed with the mounting plate and concentrically aligned with the spindle assembly; and a pawl assembly fixed to the spindle assembly and operationally engaged with the circular ratchet surface.

4. The adjustable brake of claim 1 wherein:

the spindle assembly further includes an upper support stanchion; and the spool assembly further includes an integrally formed cylindrical support hub; concentrically aligned with and rotatable about the support stanchion.

5. The adjustable brake of claim 1 wherein:

the upper caliper disk assembly includes a gland nut axially adjustable with respect to the spindle assembly;

the gland nut further comprising a support flange adjacent an axially adjustable rotor plate; and an axial adjustment means, operationally connected to the support flange, for exerting uniform axial force across the surface area of the axially adjustable rotor plate.

6. The adjustable brake of claim 5 wherein the axial adjustment means further comprises a set of bolts, in a circular regularly spaced pattern, each threaded through the support flange and contacting a set of Bellville washers adjacent the axially adjustable rotor plate.

7. The adjustable brake of claim 6 wherein the set of bolts comprises a set of eight bolts.

8. The adjustable brake of claim 1 wherein the spool assembly further comprises a rewind attachment nut concentrically situated on an external surface of the spool assembly and adapted to rotate the spool assembly to retract the collision strap.

9. A system for decelerating a vehicle with a collision strap comprising:

a first pylon rigidly fixing a first mounting plate to a surface;

a first spindle assembly pivotally mounted in the first mounting plate;

a first lower caliper disk, rigidly attached to the first spindle assembly;

a first upper caliper disk assembly, axially adjustable and rotationally fixed with respect to the first spindle assembly;

a first rotational bias means, operationally attached between the first spindle assembly and the first mounting plate, for facilitating rotation of the first spindle assembly with respect to the first mounting plate in a clockwise direction and preventing rotation of the spindle assembly with respect to the mounting plate in a counterclockwise direction;

a first spool assembly, axially aligned with and rotationally mounted on the first spindle assembly;

a first brake disk, rigidly attached to the first spool assembly;

a first upper brake lining disk, adjacent the first upper caliper disk and the first brake disk;

a first lower brake lining disk, adjacent the first lower caliper disk and the first brake disk; and a first spool channel, rigidly connected to the first spool assembly, for spooling the collision strap when the first spool assembly is rotated in the clockwise direction and for facilitating adjustable payout tension of the collision strap when the first spool assembly is rotated in the counterclockwise direction;

a second pylon rigidly fixing a second mounting plate to the surface;

a second spindle assembly pivotally mounted in the second mounting plate;

a second lower caliper disk, rigidly attached to the second spindle assembly;

a second upper caliper disk assembly, axially adjustable and rotationally fixed with respect to the second spindle assembly;

a second rotational bias means, operationally attached between the second spindle assembly and the second mounting plate, for facilitating rotation of the second spindle assembly with respect to the second mounting plate in the clockwise direction and preventing rotation of the second spindle assembly with respect to the second mounting plate in a counterclockwise direction;

a second spool assembly, axially aligned with and rotationally mounted on the second spindle assembly;

a second brake disk, rigidly attached to the second spool assembly;

a second upper brake lining disk, adjacent the second upper caliper disk and the second brake disk;

a second lower brake lining disk, adjacent the second lower caliper disk and the second brake disk; and a second spool channel, rigidly connected to the second spool assembly, for spooling the collision strap when the second spool assembly is rotated in the counterclockwise direction and for facilitating adjustable payout tension of the collision strap when the second spool assembly is rotated in the clockwise direction.

10. The system of claim 9 wherein:

the first upper caliper disk assembly exerts a first friction force on the first spool assembly; and the second upper caliper disk assembly exerts a second friction force on the second spool assembly.

11. The system of claim 9 wherein the first friction force is not equal to the second friction force.

12. The system of claim 9 wherein:

the first caliper disk assembly includes a first gland nut axially adjustable with respect to the first spindle assembly;

the first gland nut further comprises a first support flange adjacent a first axially adjustable rotor plate and a first set of bolts threaded through the first support flange and in contact with the first axially adjustable rotor plate;

the second caliper disk assembly includes a second gland nut axially adjustable with respect to the second spindle assembly; and the second gland nut further comprises a second support flange adjacent a second axially adjustable rotor plate and a second set of bolts threaded through the second support flange and in contact with the second axially adjustable rotor plate.

13. The system of claim 9 further comprising:

a first set of Bellville washers between the first set of bolts and the first axially adjustable rotor plate; and a second set of Bellville washers between the second set of bolts and the second axially adjustable rotor plate.

14. The system of claim 9 wherein:

the first rotational bias means is a first ratchet and pawl assembly; and the second rotational bias means is a second ratchet and pawl assembly.

15. A method for providing a system for controlled deceleration of a vehicle impacting a collision strap comprising:

providing a first carriage structure movably fixing a first mounting plate to a roadway surface;

providing a first spindle assembly pivotally mounted in the first mounting plate;

providing a first lower caliper disk, rigidly attached to the first spindle assembly, providing a first upper caliper disk assembly, axially adjustable and rotationally fixed with respect to the first spindle assembly;

providing a first rotational bias means, operationally attached between the first spindle assembly and the first mounting plate, for facilitating rotation of the first spindle assembly with respect to the first mounting plate in a clockwise direction and preventing rotation of the spindle assembly with respect to the mounting plate in a counterclockwise direction;

providing a first spool assembly, axially aligned with and rotationally mounted on the first spindle assembly;

providing a first brake disk, rigidly attached to the first spool assembly;

providing a first upper brake lining disk, adjacent the first upper caliper disk assembly and the first brake disk;

providing a first lower brake lining disk, adjacent the first lower caliper disk and the first brake disk; and providing a first spool channel, rigidly connected to the first spool assembly, for spooling the collision strap when the spool assembly is rotated in the clockwise direction and for facilitating adjustable payout tension of the collision strap when the spool assembly is rotated in the counterclockwise rotational direction;

providing a second carriage structure movably fixing a second mounting plate to the roadway surface;

providing a second spindle assembly pivotally mounted in the second mounting plate;

providing a second lower caliper disk, rigidly attached to the second spindle assembly;

providing a second upper caliper disk assembly, axially adjustable and rotationally fixed with respect to the second spindle assembly;

providing a second rotational bias means, operationally attached between the second spindle assembly and the second mounting plate, for facilitating rotation of the second spindle assembly with respect to the second mounting plate in the counterclockwise direction and preventing rotation of the second spindle assembly with respect to the mounting plate in the clockwise direction;

providing a second spool assembly, axially aligned with and rotationally mounted on the second spindle assembly;

providing a second brake disk, rigidly attached to the second spool assembly;

providing a second upper brake lining disk, adjacent the second upper caliper disk and the second brake disk;

providing a second lower brake lining disk, adjacent the second lower caliper disk and the second brake disk;

providing a second spool channel, rigidly connected to the second spool assembly, for spooling the collision strap when the spool assembly is rotated in the counterclockwise direction and for facilitating adjustable payout tension of the collision strap when the spool assembly is rotated in the clockwise direction;

axially adjusting the first upper caliper disk to exert a first frictional force; and axially adjusting the second upper caliper disk to exert a second frictional force.

16. The method of claim 15 wherein the step of axially adjusting the first upper caliper disk assembly includes axially adjusting the first upper caliper disk assembly to an adjustment where the first frictional force is higher than the second frictional force.

17. The method of claim 15 comprising vertically adjusting the first carriage structure and the second carriage structure to accomplish one of the group of matching a center height of the vehicle and allowing passage of the vehicle.

18. The method of claim 15 wherein the step of axially adjusting the first caliper disk assembly includes adjusting the first caliper disk assembly to a frictional force of one of the group of:

between 10% and 30% of the second frictional force, between 30% and 50% of the second frictional force, between 50% and 80% of the second frictional force; and between 80% and 100% of the second frictional force.

19. An adjustable brake for a collision strap comprising:

a frame;

a mounting plate rigidly attached to the frame;

a spring loaded pawl biased against a circular ratchet plate biasing the circular ratchet plate to move in one of a clockwise direction and a counterclockwise direction;

a spindle assembly having a central axis, pivotally supported by the mounting plate about the central axis;

the spindle assembly further comprising an integrally formed caliper disk adjacent the mounting plate;

a first collinear stanchion adjacent the caliper disk and a second collinear stanchion adjacent the first collinear stanchion;

the spindle assembly further comprising a gland nut adjustably threaded onto the first collinear stanchion;

the gland nut further comprising an integrally formed flange;

an axially movable caliper plate adjacent the flange and biased against rotation with respect to the spindle assembly by the first stanchion;

a set of bolts threaded through the flange and in contact with the axially movable caliper plate;

a brake disk assembly between the caliper disk and the caliper plate;

the brake disk assembly rigidly connected to a spool assembly;

the spool assembly comprising a spool channel rigidly connected to the brake disk assembly for spooling the collision strap;

the spool channel further connected to a central spool hub;

the central spool hub rotationally supported by and coaxial with the second collinear stanchion; and whereby the brake disk assembly slides between the caliper plate and the caliper disk upon deployment of the collision strap from the spool channel whereby the brake disk assembly is fixed with respect to the caliper plate and the caliper disk upon rewind of the collision strap into the spool channel.

20. The adjustable brake of claim 19 wherein the brake disk assembly comprises a brake disk, a first brake pad fused to a first surface of the brake disk and a second brake pad fused to a second surface of the brake disk.

21. The adjustable brake of claim 19 wherein the brake disk assembly comprises a brake disk, a first brake pad adjacent the brake disk and a second brake pad adjacent the brake disk.

22. A system for deploying a vehicle decelerating barrier comprising:

a first carriage in vertically movable contact with a frame;

a first cable connected to the first carriage and looped over a first set of pulleys and connected to a first weight;

a first chain connected to the first carriage at a first location in operational contact with a gear and further in operational contact with a first sprocket and connected to the first carriage in a second location;

a motor rigidly attached to the frame and operationally connected to the gear;

a driveshaft rigidly fixed to the first sprocket and a second sprocket and rotatably connected to the frame;

a second chain connected to a second carriage at a third location in operational contact with a third sprocket and further in operational contact with the second sprocket and connected to the second carriage in a fourth location;

a second cable connected to the second carriage and looped over a second set of pulleys and connected to a second weight;

a first braking mechanism having a first braking force and rigidly attached to the first carriage;

a second braking mechanism having a second braking force and rigidly attached to the second carriage;

a first collision strap wound about the first braking mechanism and adjacent a first guide roller and a second guide roller and further connected to a first tension wire and a second tension wire;

the first tension wire and the second tension wire interwoven throughout the vehicle decelerating barrier and connected to a second collision strap;

the second collision strap wound about the second braking mechanism and adjacent a third guide roller and a fourth guide roller; and the second carriage in vertically movable contact with the frame.

23. The system of claim 22 further comprising a set of limit switches adjacent the frame for generating a control signal related to the height of the first carriage.

24. The system of claim 22 wherein the first braking force is equal to the second braking force.

25. The system of claim 22 wherein the first braking force is not equal to the second braking force.

* * * * *